US011389014B2

(12) United States Patent
Reifert

(10) Patent No.: US 11,389,014 B2
(45) Date of Patent: Jul. 19, 2022

(54) SELF-STANDING MERCHANDISE FRAME

(71) Applicant: FRAMEWORKS, LLC, Muscatine, IA (US)

(72) Inventor: Kyle Reifert, Muscatine, IA (US)

(73) Assignee: FRAMEWORKS, LLC, Muscatine, IA (US)

( * ) Notice: Subject to any disclaimer, the term of this patent is extended or adjusted under 35 U.S.C. 154(b) by 0 days.

(21) Appl. No.: 17/404,985

(22) Filed: Aug. 17, 2021

(65) Prior Publication Data

US 2021/0369010 A1 Dec. 2, 2021

Related U.S. Application Data

(63) Continuation of application No. 17/002,721, filed on Aug. 25, 2020, now Pat. No. 11,089,883, which is a (Continued)

(51) Int. Cl.
*A47F 5/00* (2006.01)
*A47F 5/01* (2006.01)
(Continued)

(52) U.S. Cl.
CPC ..... *A47F 5/0031* (2013.01); *A47F 5/01* (2013.01); *A47F 5/083* (2013.01); *A47F 5/13* (2013.01);
(Continued)

(58) Field of Classification Search
CPC .. A47F 5/0031; A47F 5/01; A47F 5/13; A47F 5/083; A47F 5/14; A47F 5/04; A47F 5/0807; A47F 5/00; A47F 7/00; A47B 57/06; A47B 57/16; A47B 57/46; A47B 47/022; A47B 47/00; G09F 7/18; G09F 15/00; G09F 15/0012; G09F 15/0037; G09F 15/0056
USPC ..... 211/133.4, 205, 181.1, 187, 188, 90.03, 211/90.02; 40/606.01, 608, 607.1, 40/607.01; 248/158, 121, 688, 146, 175, 248/159, 157; D6/712, 709.2
See application file for complete search history.

(56) References Cited

U.S. PATENT DOCUMENTS 846,359 A 3/1907 Sparmaker
1,752,985 A 4/1930 Cooper
(Continued)

FOREIGN PATENT DOCUMENTS

AU 2005203373 A1 2/2006
DE 202006006164 U1 11/2006
EP 1541066 A1 6/2005

OTHER PUBLICATIONS

International Search Report, PCT International Searching Authority, dated Sep. 12, 2019, PCT/US2019/029694.

*Primary Examiner* — Devin K Barnett
(74) *Attorney, Agent, or Firm* — Hamilton IP Law, PC; Jay R Hamilton; Charles A. Damschen

(57) ABSTRACT

A Self-Standing Merchandise Frame is provided for displaying merchandise items on a store and allowing the attachment of multiple racks of numerous sizes, for instance, 24 inches, 48 inches and 96 inches. The embodiment is configured of a sign plate, a first and a second vertical tubes, an upper and a lower support and a base plate which structurally support the self-standing of the frame. Depend on the particular application, Self-Standing Merchandise Frame could be assembled as a single stand or a double stand, without any limitation and restriction.

9 Claims, 35 Drawing Sheets

Related U.S. Application Data continuation of application No. 16/397,734, filed on Apr. 29, 2019, now Pat. No. 10,750,883.

(60) Provisional application No. 62/663,692, filed on Apr. 27, 2018.

(51) Int. Cl.

| | |
|---|---|
| ***A47F 5/13*** | (2006.01) |
| ***A47F 5/08*** | (2006.01) |
| *A47B 57/06* | (2006.01) |
| *A47B 57/16* | (2006.01) |
| *A47B 57/46* | (2006.01) |
| *A47B 47/02* | (2006.01) |
| *A47B 47/00* | (2006.01) |

(52) U.S. Cl.

CPC ..... *A47B 47/00* (2013.01); *A47B 47/022* (2013.01); *A47B 57/06* (2013.01); *A47B 57/16* (2013.01); *A47B 57/46* (2013.01)

(56) References Cited

U.S. PATENT DOCUMENTS

| | | | |
|---|---|---|---|
| 2,447,704 | A | 8/1948 | Donald |
| D153,909 | S | 5/1949 | Wais |
| 2,495,109 | A | 1/1950 | Ferdinand |
| 2,692,175 | A | 10/1954 | Jacques |
| 2,794,695 | A | 6/1957 | Garnett |
| 2,802,576 | A | 8/1957 | Kelling |
| 2,857,228 | A | 10/1958 | Koett |
| 2,864,512 | A | 12/1958 | Daniel |
| D186,254 | S | 9/1959 | Tirlet |
| 3,091,345 | A | 5/1963 | Hoose et al. |
| 3,101,681 | A | 8/1963 | Streater |
| 3,122,238 | A | 2/1964 | Brunette |
| D199,342 | S | 10/1964 | Durham |
| 3,171,541 | A | 3/1965 | David |
| 3,172,539 | A | 3/1965 | Rulf |
| 3,229,823 | A | 1/1966 | Hummer |
| 3,330,518 | A | 7/1967 | Adler |
| 3,401,653 | A | 9/1968 | Knoblock |
| 3,429,449 | A | 2/1969 | Hamilton et al. |
| 3,435,958 | A | 4/1969 | Chesley |
| 3,532,224 | A | 10/1970 | Grubb et al. |
| 3,693,808 | A | 9/1972 | Rauch |
| 3,726,415 | A | 4/1973 | Malik |
| 3,730,108 | A | 5/1973 | Stroh |
| 3,850,300 | A | 11/1974 | Young |
| 4,037,851 | A | 7/1977 | Romero |
| 4,068,855 | A | 1/1978 | Hackett |
| 4,106,736 | A | 8/1978 | Becker, III et al. |
| 4,126,288 | A | 11/1978 | Sisto et al. |
| 4,127,196 | A | 11/1978 | Boucher |
| D253,323 | S | 11/1979 | Blatzer et al. |
| 4,226,190 | A | 10/1980 | Ashton |
| D267,683 | S | 1/1983 | Kates |
| 4,403,554 | A | 9/1983 | Valentine et al. |
| D273,337 | S | 4/1984 | Semerjian et al. |
| D279,057 | S | 6/1985 | Bolduc |
| 4,586,618 | A | 5/1986 | Norman |
| D291,164 | S | 8/1987 | Luyk et al. |
| 4,697,712 | A | 10/1987 | Valiulis |
| D296,160 | S | 6/1988 | Rhodes |
| 4,785,742 | A | 11/1988 | Esslinger |
| D300,485 | S | 4/1989 | Scholl |
| 4,819,899 | A | 4/1989 | Weil |
| 4,884,702 | A | 12/1989 | Rekow |
| 4,890,747 | A | 1/1990 | Sayers |
| 4,919,280 | A | 4/1990 | Phillips |
| 4,932,540 | A | 6/1990 | Pfeifer |
| D309,388 | S | 7/1990 | Kee |
| 4,960,214 | A | 10/1990 | Sayers |
| 5,031,783 | A | 7/1991 | Goudreau |
| 5,417,168 | A | 5/1995 | Soper |
| 5,439,122 | A | 8/1995 | Ramsay |
| 5,449,076 | A | 9/1995 | Van Noord |
| 5,482,168 | A | 1/1996 | Welch et al. |
| D366,781 | S | 2/1996 | Cartwright |
| 5,529,322 | A | 6/1996 | Barton |
| 5,547,271 | A | 8/1996 | Rydell |
| 5,573,124 | A | 11/1996 | Frost |
| D376,931 | S | 12/1996 | Fewchuk |
| 5,582,302 | A | 12/1996 | Kozak |
| 5,588,543 | A | 12/1996 | Finger |
| 5,644,994 | A | 7/1997 | Liang et al. |
| 5,752,610 | A | 5/1998 | Remmers |
| 5,769,248 | A | 6/1998 | Johnson |
| 5,797,501 | A | 8/1998 | Von Gunten |
| D402,821 | S | 12/1998 | Kozak |
| 5,871,115 | A | 2/1999 | Kohn |
| 5,881,892 | A | 3/1999 | Loo |
| 5,947,307 | A | 9/1999 | Battaglia et al. |
| D422,163 | S | 4/2000 | Pendergrast |
| 6,082,560 | A | 7/2000 | Timm |
| 6,089,387 | A | 7/2000 | Varfolomeeva |
| 6,164,462 | A | 12/2000 | Mumford |
| 6,241,107 | B1 | 6/2001 | Boyer |
| 6,299,001 | B1 | 10/2001 | Frolov et al. |
| 6,364,137 | B1 | 4/2002 | Glauth et al. |
| 6,405,880 | B1 | 6/2002 | Webb |
| 6,564,952 | B1 | 5/2003 | Suttles |
| 6,575,315 | B2 | 6/2003 | Zidek |
| 6,659,295 | B1 | 12/2003 | De Land et al. |
| 6,726,034 | B2 | 4/2004 | Holbrook et al. |
| D500,416 | S | 1/2005 | Sparkowski |
| D507,710 | S | 7/2005 | Fletcher et al. |
| 7,128,221 | B2 | 10/2006 | Metcalf |
| 7,178,681 | B2 | 2/2007 | Libman |
| 7,188,740 | B2 | 3/2007 | Marchetta et al. |
| D559,577 | S | 1/2008 | Quinn |
| 7,448,634 | B1 | 11/2008 | Raub |
| 7,533,948 | B2 | 5/2009 | Smith et al. |
| D595,977 | S | 7/2009 | Stebbens et al. |
| 7,571,821 | B2 | 8/2009 | Colin |
| 7,631,604 | B2 | 12/2009 | Huang |
| D612,169 | S | 3/2010 | Chang |
| 7,815,202 | B2 | 10/2010 | Richards et al. |
| D626,355 | S | 11/2010 | Liang |
| D640,485 | S | 6/2011 | Dugger |
| 7,954,656 | B1 | 6/2011 | Cuzzocrea |
| 7,959,020 | B2 | 6/2011 | Rosen |
| D649,819 | S | 12/2011 | Malik |
| 8,540,088 | B2 | 9/2013 | Brasher |
| 8,616,388 | B2 | 12/2013 | Butler |
| 8,636,156 | B2 | 1/2014 | Malik |
| 8,776,414 | B2 | 7/2014 | Clark et al. |
| D716,080 | S | 10/2014 | Bell et al. |
| D720,161 | S | 12/2014 | Udagawa et al. |
| 8,919,583 | B2 | 12/2014 | Brasher |
| D726,421 | S | 4/2015 | Rue et al. |
| 9,004,300 | B1 | 4/2015 | Morrell |
| D729,553 | S | 5/2015 | Trinh et al. |
| D734,079 | S | 7/2015 | Roth |
| 9,271,584 | B1 | 3/2016 | Weinstein et al. |
| D785,381 | S | 5/2017 | Johnson |
| D790,892 | S | 7/2017 | Chung |
| D798,067 | S | 9/2017 | Felsenthal et al. |
| 9,756,939 | B1 | 9/2017 | Ruiz et al. |
| 9,936,825 | B1 | 4/2018 | Lindblom et al. |
| 10,021,996 | B2 | 7/2018 | Cantwell et al. |
| 10,058,172 | B2 | 8/2018 | Staib |
| D838,127 | S | 1/2019 | Theodoroff et al. |
| D841,374 | S | 2/2019 | Felsenthal et al. |
| D849,458 | S | 5/2019 | Nichols et al. |
| D862,946 | S | 10/2019 | Hyland |
| 10,470,590 | B2 | 11/2019 | Wills et al. |
| D881,646 | S | 4/2020 | Zhao |
| D915,796 | S | 4/2021 | Koplent-Zinyk |
| 2002/0027115 | A1 | 3/2002 | Gay |
| 2002/0033373 | A1 | 3/2002 | Robertson |
| 2002/0130098 | A1 | 9/2002 | Simard |
| 2003/0168951 | A1 | 9/2003 | Holbrook et al. |
| 2003/0205545 | A1 | 11/2003 | Moceri |

(56) References Cited

U.S. PATENT DOCUMENTS

| | | | |
|---|---|---|---|
| 2004/0050814 | A1 | 3/2004 | Roush et al. |
| 2004/0060884 | A1 | 4/2004 | Nook et al. |
| 2004/0084392 | A1 | 5/2004 | Richter et al. |
| 2004/0256341 | A1 | 12/2004 | Donnell et al. |
| 2005/0000924 | A1 | 1/2005 | Webb |
| 2005/0011420 | A1 | 1/2005 | Costa et al. |
| 2005/0011844 | A1 | 1/2005 | Magnusson et al. |
| 2005/0109720 | A1 | 5/2005 | Marchetta |
| 2005/0145147 | A1 | 7/2005 | Costa et al. |
| 2005/0252872 | A1 | 11/2005 | Eisele |
| 2005/0263466 | A1 | 12/2005 | Libman |
| 2005/0279041 | A1 | 12/2005 | Staples et al. |
| 2006/0032829 | A1 | 2/2006 | Hutzler |
| 2006/0091092 | A1 | 5/2006 | Vosbikian |
| 2006/0180557 | A1 | 8/2006 | Weinstein et al. |
| 2007/0023376 | A1 | 2/2007 | Black |
| 2007/0045209 | A1 | 3/2007 | Richardson et al. |
| 2007/0295681 | A1 | 12/2007 | Colin |
| 2008/0179267 | A1 | 7/2008 | Johnson |
| 2009/0039040 | A1 | 2/2009 | Johnson et al. |
| 2009/0188875 | A1 | 7/2009 | Wade et al. |
| 2010/0032394 | A1 | 2/2010 | Wang |
| 2013/0193098 | A1 | 8/2013 | Fanourgiakis et al. |
| 2013/0213918 | A1 | 8/2013 | Doyle, Jr. et al. |
| 2013/0220957 | A1 | 8/2013 | Malik |
| 2013/0306583 | A1 | 11/2013 | Caldwell |
| 2014/0149242 | A1 | 5/2014 | Turner, Jr. et al. |
| 2015/0150387 | A1 | 6/2015 | Turner et al. |
| 2015/0313357 | A1 | 11/2015 | David et al. |
| 2016/0106235 | A1 | 4/2016 | Mason |
| 2017/0202349 | A1 | 7/2017 | Ou |
| 2019/0112122 | A1 | 4/2019 | Balicki et al. |
| 2019/0357700 | A1 | 11/2019 | Reifert |
| 2021/0045523 | A1 | 2/2021 | Maynes |
| 2021/0076814 | A1 | 3/2021 | Maynes |

SELF-STANDING MERCHANDISE FRAME

CROSS REFERENCE TO RELATED APPLICATIONS

The present application is a continuation of a non-provisional patent application and claims priority from the utility non-provisional U.S. patent application Ser. No. 17/002,721 (issued as U.S. Pat. No. 11,089,883 on Aug. 17, 2021) which was a continuation of Ser. No. 16/397,734 filed on Apr. 29, 2019 (issued as U.S. Pat. No. 10,750,883 on Aug. 25, 2020), which claimed priority from utility provisional U.S. Pat. App. No. 62/663,692 filed on Apr. 27, 2018, which are all incorporated by reference herein in their entireties.

FIELD OF THE INVENTION

The present disclosure relates to a self-standing merchandise frame for multiple racks having a sign plate and a self-support frame without any restriction and limitation, as shown and disclosed herein.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. § 1.171 (d)(c)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BRIEF DESCRIPTION OF THE DRAWINGS

The accompanying drawings, which are incorporated in and constitute a part of this specification, illustrate embodiments and together with the description, serve to explain and illustrate the principles of the Self-Standing Merchandise Frame as disclosed herein.

Figure 1A:
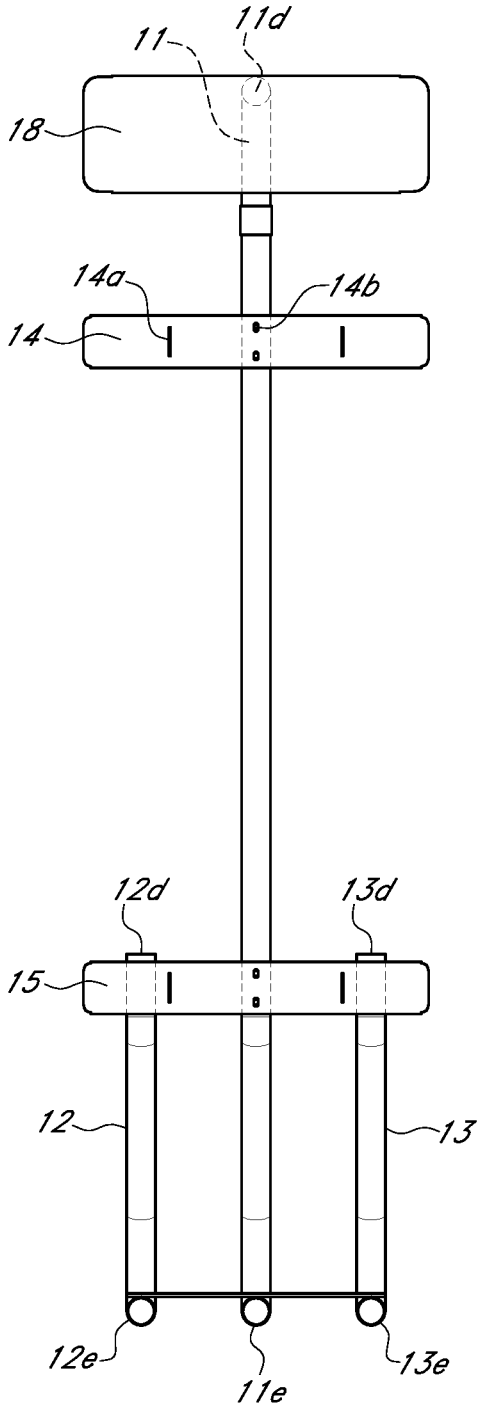
FIG. 1A is a front view of a single stand of the Self-Standing Merchandise Frame (width of 24 inches) without the grid wall disclosed herein along with detailed call-outs for enablement of the present disclosure.

Appendix A is included herein and provides additional inventor disclosure and description for implementation, as provided by the inventor for inclusion herein, and may be claimed in whole or in part, for its use in the implementation of the present disclosure and is fully incorporated by reference herein.

DETAILED DESCRIPTION - TABLE OF ELEMENTS

| Element Description | Element Number |
|---|---|
| Wall (not shown) | 1 |
| Merchandise products (Snacks, candies, gums, etc.) | 2 |
| Coffee maker | 3 |
| Screw | 4 |
| Bolt | 5 |
| Mounting bracket | 6 |
| Self-standing merchandise frame | 10 |
| First vertical tube | 11 |
| Upper portion | 11a |
| Upper curved radius | 11a-1 |
| Middle portion | 11b |
| Lower portion | 11c |
| Angled portion | 11c-1 |
| Lower curved radius | 11c-2 |
| First end | 11d |
| Second end | 11e |
| Hole (not shown) | 11f |
| Slot (not shown) | 11g |
| Second vertical tube | 12 |
| Upper portion | 12a |
| Upper curved radius | 12a-1 |
| Middle portion | 12b |
| Lower portion | 12c |
| Angled portion | 12c-1 |
| Lower curved radius | 12c-2 |
| First end | 12d |
| Second end | 12e |
| Hole (not shown) | 12f |
| Slot (not shown) | 12g |
| Third vertical tube | 13 |
| Upper portion | 13a |
| Upper curved radius | 13a-1 |
| Middle portion | 13b |
| Lower portion | 13c |
| Angled portion | 13c-1 |

-continued

DETAILED DESCRIPTION - TABLE OF ELEMENTS

| Element Description | Element Number |
|---|---|
| Lower curved radius | 13c-2 |
| First end | 13d |
| Second end | 13e |
| Hole (not shown) | 13f |
| Slot (not shown) | 13g |
| Upper support | 14 |
| Slot (for attachment of the grid wall) | 14a |
| Hole (for attachment of the vertical tubes) | 14b |
| Lower support | 15 |
| Slot (for attachment of the grid wall) | 15a |
| Hole (for attachment of the vertical tubes) | 15b |
| Mounting support hook | 16 |
| Hook | 17 |
| Sign plate | 18 |
| Base plate | 19 |
| Grid wall | 20 |
| Upper portion | 20a |
| Middle portion | 20b |
| Lower portion | 20c |
| Side panel | 21 |
| Small side panel | 21a |
| Medium side panel | 21b |
| Large side panel | 21c |
| Basket | 22 |
| Rack | 23 |
| Shelf | 24 |
| Secure access box | 25 |
| DVR | 26 |
| Floor surface (not shown) | 27 |
| Extender arm (not shown) | 30 |

DETAILED DESCRIPTION

Before the present methods and apparatuses are disclosed and described, it is to be understood that the methods and apparatuses are not limited to specific methods, specific components, or to particular implementations. It is also to be understood that the terminology used herein is for the purpose of describing particular embodiments only and is not intended to be limiting.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another embodiment includes—from the one particular value and/or to the other particular value. Similarly, when values are expressed as approximations, by use of the antecedent "about," it will be understood that the particular value forms another embodiment. It will be further understood that the endpoints of each of the ranges are significant both in relation to the other endpoint, and independently of the other endpoint.

"Optional" or "optionally" means that the subsequently described event or circumstance may or may not occur, and that the description includes instances where said event or circumstance occurs and instances where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal embodiment. "Such as" is not used in a restrictive sense, but for explanatory purposes.

Disclosed are components that can be used to perform the disclosed methods and apparatuses. These and other components are disclosed herein, and it is understood that when combinations, subsets, interactions, groups, etc. of these components are disclosed that while specific reference of each various individual and collective combinations and permutation of these may not be explicitly disclosed, each is specifically contemplated and described herein, for all methods and apparatuses. This applies to all aspects of this application including, but not limited to, steps in disclosed methods. Thus, if there are a variety of additional steps that can be performed it is understood that each of these additional steps can be performed with any specific embodiment or combination of embodiments of the disclosed methods.

The present methods and apparatuses may be understood more readily by reference to the following detailed description of preferred aspects and the examples included therein and to the Figures and their previous and following description.

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

Products or merchandise products of various types and sizes are commonly displayed on the shelves in the stores, gas station, supermarket, etc. which allow the customer to see and grasp the products or merchandise products directly from the shelves or merchandise display rack. The display of the merchandise units on the merchandise shelves or merchandise racks allow the customer to select the products more easily; thus, increases the customer's interest of purchasing.

The illustrative embodiment of a self-standing merchandise frame may be configured with a sign plate, a first vertical tube, a second vertical tube, a third vertical tube, an upper support, a lower support and a base plate. The first, second and third vertical tubes are configured to support the self-standing mechanism. The upper support and the lower support are configured to engage with a grid wall. The grid wall allows the attachment of multiple shelves, racks or baskets to be attached to the self-standing merchandise frame. The present embodiment provides a simple, inexpensive structure for merchandise display which is constructed of a minimum of parts and which can be quickly assembled and disassembled.

In addition, the present disclosure details a self-standing merchandise frame that overcomes various disadvantages and otherwise undesirable features of the prior art. In addition, the illustrative embodiment of a self-standing merchandise frame may solve numerous problems associated with prior art merchandise display and storage. For instance, the problem of having a wall to support the standing of the merchandise frame may be solved by a frame having at least one vertical tube wherein the vertical tube has an upper curved radius and a lower curved radius to allow a self-standing merchandise frame. The problem of having limited display space in prior art merchandise frames may be solved by having multiple display units, exemplified as a hook, a shelf, a basket, a tray and or a rack, or a combination therein, attached to a grid wall. The problem of complicated construction, numerous parts, and expense of prior art merchandise frames may be solved by the self-standing merchandise frame disclosed and claimed herein which is easy to assemble, store and transport and may be configured in a multitude of ways.

Illustrative Embodiment and Advantages

Figure 1B:
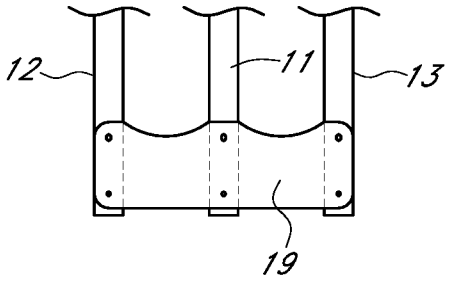
FIG. 1B is a top view of a base plate of the Self-Standing Merchandise Frame positioned on the lower portion of the vertical tubes as shown in FIG. 1A herein.
Figure 1C:
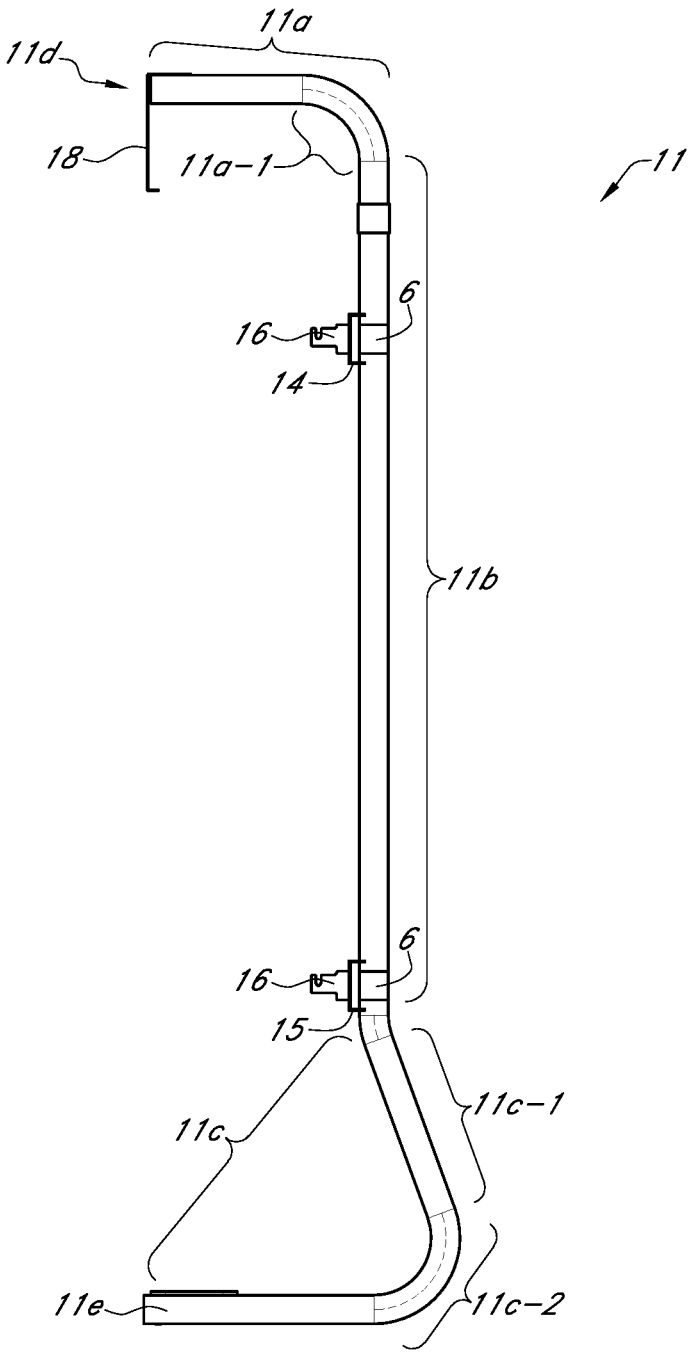
FIG. 1C is a side view of the Self-Standing Merchandise Frame without the grid wall as shown in FIG. 1A herein.
Figure 1D:
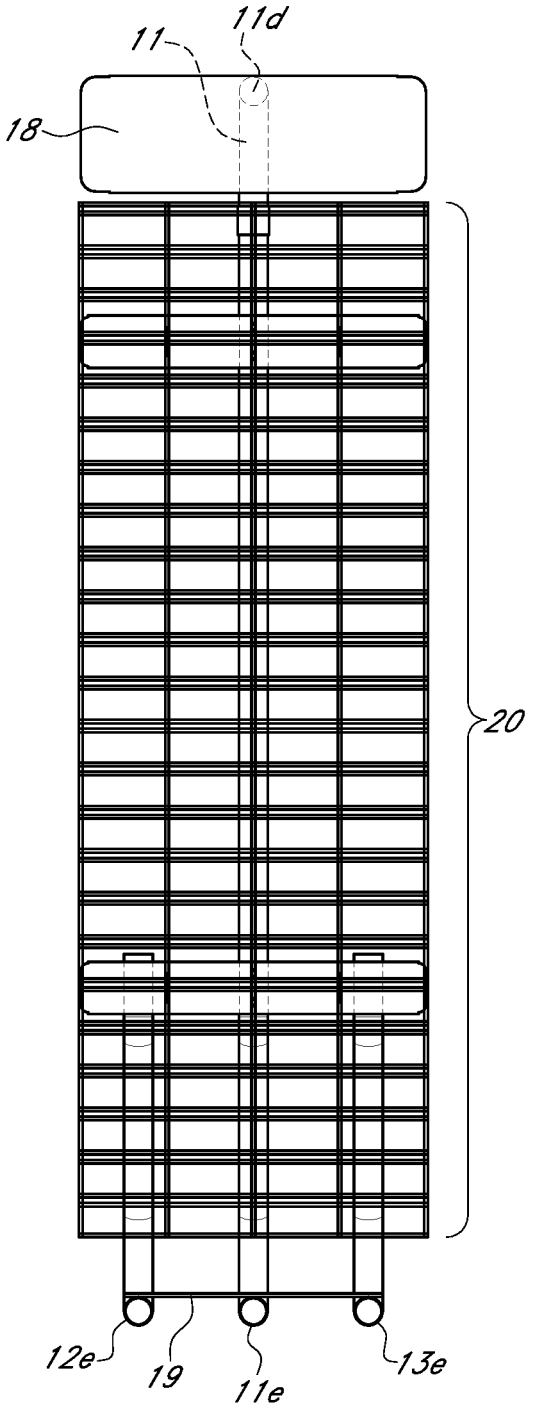
FIG. 1D is a front view of the Self-Standing Merchandise Frame with the grid wall as shown in FIG. 1C herein.
Figure 1E:
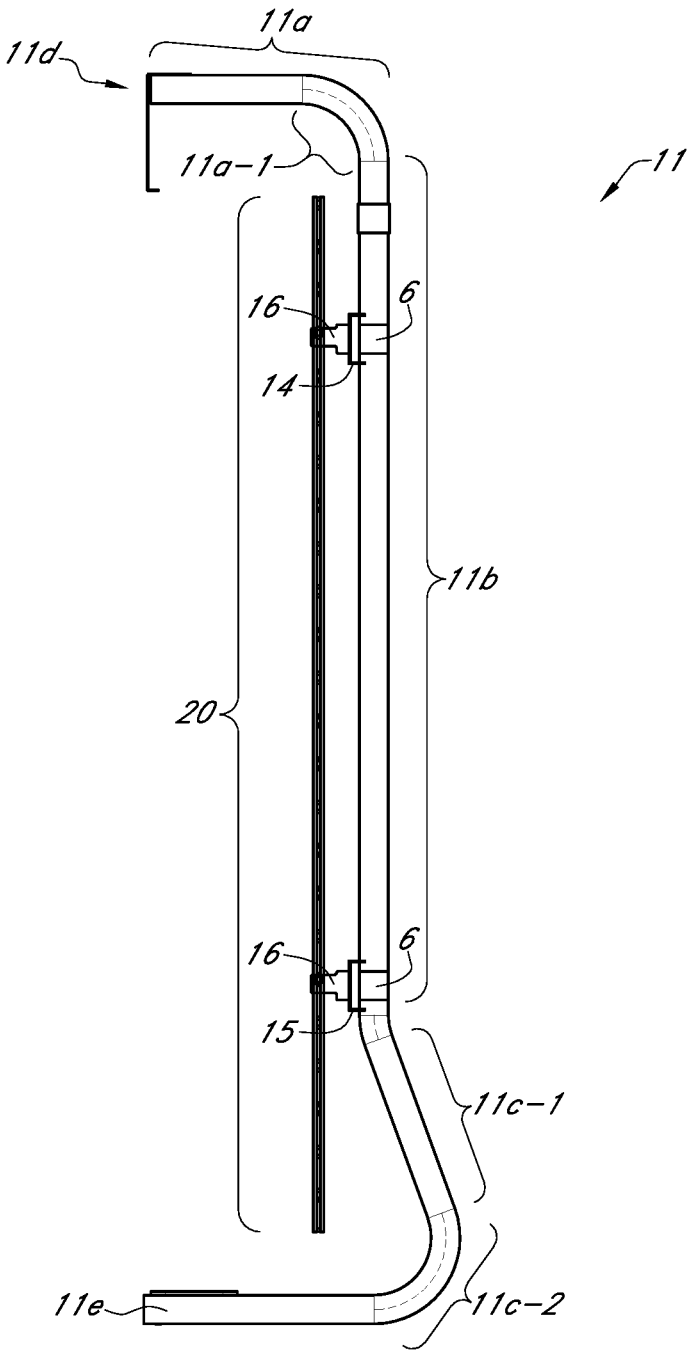
FIG. 1E is a side view of the Self-Standing Merchandise Frame with the attachment of the grid wall to the horizontal tubes as shown in FIG. 1D herein.
Figure 1F:
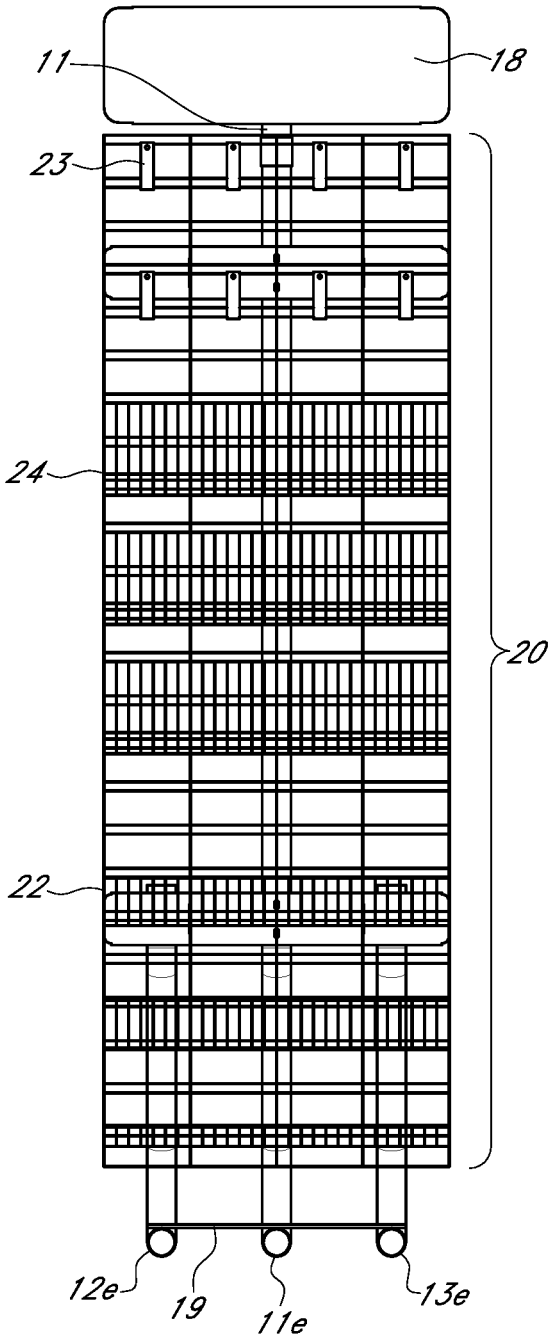
FIG. 1F is a perspective view of the Self-Standing Merchandise Frame with the grid wall and the shelfs as shown herein.

The present disclosure relates to a self-standing merchandise frame 10. FIG. 1A is a front view of a single stand of the self-standing merchandise frame 10 (width of 24 inches) disclosed herein along with detailed call-outs for enablement of the present disclosure. FIG. 1B is a top view of a base plate 19 of the self-standing merchandise frame 10 positioned on the lower portion of the vertical tubes as shown in FIG. 1A herein. FIG. 1C is a side view of the self-standing merchandise frame 10 without the grid wall 19 as shown in FIG. 1A herein. FIG. 1D is a front view of the self-standing merchandise frame 10 with the grid wall 20 as shown in FIG. 1C herein. FIG. 1E is a side view of the self-standing merchandise frame 10 with the attachment of the grid wall 20 to the upper support 14 and the lower support 15 as shown in FIG. 1D herein. FIG. 1F is a perspective view of the Self-standing merchandise frame 10 with the attachment of the grid wall 20 and the shelfs 24 as shown herein.

In one embodiment, referring to FIG. 1A-1F, the self-standing merchandise frame 10 is configured with a sign plate 18, an upper support 14, a lower support 15, a first vertical tube 11, a second vertical tube 12, a third vertical tube 13 and a base plate 19. As shown, the sign plate 18 is configured to engage with a first end 11*d* of the first vertical tube. In one embodiment, the first end 11*d* of the first vertical tube may be positioned to align with the second end 11*e* of the first vertical tube (as shown in FIG. 1C) but in another embodiment, it may be constructed to be positioned proximate the vertical tubes for a better merchandise display (not shown). The first vertical tube 11 is configured with an upper portion 11*a*, a middle portion 11*b* and a lower portion 11*c* wherein the upper portion 11*a* of the first vertical tube is configured to engage with the sign plate 18 and the lower portion 11*c* of the first vertical tube is configured to engage with the base plate 19. The middle portion 11*b* of the first vertical tube has an upper curved radius 11*a*-1 transiting to the upper portion 11*a* of the first vertical tube. The middle portion 11*b* of the first vertical tube has an angled portion 11*c*-1 and a lower curved radius 11*c*-2 transiting to the lower portion 11*c* of the first vertical tube. The second vertical tube 12 is configured with an upper portion 12*a*, a middle portion

12*b* and a lower portion 12*c* wherein the upper portion 12*a* of the second vertical tube terminates below the upper portion 11*a* of the first vertical tube and the middle portion 12*b* of the second vertical tube has an angled portion 12*c*-1 and a lower curved radius 12*c*-2 transitioning to the lower portion 12*b* of the second vertical tube. The third vertical tube 13 is configured with an upper portion 13*a*, a middle portion 13*b* and a lower portion 13*c* wherein the upper portion 13*a* of the third vertical tube terminates below the upper portion 11*a* of the first vertical tube and the middle portion 13*b* of the third vertical tube has an angled portion 13*c*-1 and a lower curved radius 13*c*-2 transitioning to the lower portion 13*c* of the third vertical tube. The second vertical tube 12 and the third vertical tube 13 are configured to provide balance and structural support to allow the merchandise frame 10 to be self-standing. The lower portion of the first 11*c*, the second 12*c* and the third 13*c* vertical tubes are configured to engage with the floor surface 27 (not shown) and provide structural support for the self-standing merchandise frame 10. The base plate 19 is configured to engage with and position on top of the lower portion of the first 11*c*, the second 12*c* and the third 13*c* vertical tubes to secure and provide further structural support to the self-standing merchandise frame 10.

The upper portion 11*a* of the first vertical tube (as shown in FIG. 1C) is parallel with the lower portion 11*c* of the first vertical tube to provide more stability and more structural support to the self-standing merchandise frame 10. Dependent on the particular application, the angle between the upper portion 11*a* and the lower portion 11*c* of the first vertical tube may be customized between the range of 0 degrees (same direction with each other) to 180 degrees (opposite direction with each other), without any limitation and or restriction. As shown in FIGS. 1A-1F, the angle between the upper portion 11*a* of the first vertical tube and the lower portion 11*c* of the first vertical tube is 0 (zero) degrees.

As shown in FIG. 1C, the angle of the upper curved radius 11*a*-1 and the lower curved radius 11*c*-1 of the first vertical tube is approximately 160 degrees but not limited to any value between a range of 100-360 degrees. The radius of the upper curved radius 11*a*-1 and the lower curved radius 11*c*-1 of the first vertical tube is approximately 5 inches, but not limited to any value between a range of 4-10 inches. The angle of the lower curved radius of the second 12*c*-1 and the third 13*c*-1 vertical tubes is approximately 160 degrees but not limited to any value between a range of 100-360 degrees. The radius of the lower curved radius of the second 12*c*-1 and the third 13*c*-1 vertical tubes is approximately 5 inches, but not limited to any value between a range of 4-10 inches. One of ordinary skill will appreciate that the angle and the radius of the upper curved radius and the lower curved radius of each vertical tube can be customized to as suitable for a particular application to support the self-standing of the embodiment without any limitation and/or restriction unless otherwise indicated in the following claims.

The upper support 14 and the lower support 15 are configured for attachment along the length of the first vertical tube 11. The upper support 14 is configured for horizontal attachment to the lower portion 11*c* of the first vertical tube. The upper support 14 may be secured to the first vertical tube 11 by inserting a screw 4, a bolt 5 or a mounting bracket 6 to at least one hole 11*f* on the first vertical tube 11 (not shown). The upper support 14 is positioned proximate to the upper curved radius 11*a*-1 of the first vertical tube. The lower support 15 is configured for horizontal attachment between the first 11, the second 12 and the third 13 vertical tubes. The lower support 15 may be secured to the first 11, the second 12 and the third 13 vertical tubes by inserting a screw 4, a bolt 5 or a mounting bracket 6 to at least one hole on each of the first 11*f*, the second 12*f* and the third 13*f* vertical tubes (not shown). The lower support 15 positions proximately to the lower curved radius of the first 11*c*-1, the second 12*c*-1 and third 13*c*-1 vertical tubes. One of ordinary skill will appreciate that the upper support 14 and the lower support 15 are removable which allows the self-standing merchandise frame 10 to be disassembled during transportation and storage. One of ordinary skill will also appreciate that each vertical tube is configured of at least two holes (11*f*, 12*f*, 13*f*—not shown) and or at least two slots (11*g*, 12*g*, 13*g*—not shown) along the length of each of the vertical tubes which allows the upper support 14 and the lower support 15 to be adjustable in height. One of ordinary skill will appreciate that the embodiments disclosed herein may also be produced to have the various elements permanently affixed, i.e. welding the upper support 14 and the lower support 15 to the vertical tubes (not shown), or producing the various components using a one-piece integral type construction from either metal or plastic (not shown), as suitable to a particular application, without departure from the spirit of the application as disclosed herein.

Another feature of the embodiment is the grid wall 20 (as shown in FIGS. 1D-1F). The grid wall 20 is configured for attachment to and between the upper support 14 and the lower support 15 wherein the upper support 14 is attached to the upper portion 11*a* of the first vertical tube and the lower support 15 is attached to the lower portion 11*c* of the first vertical tube, the upper portion 12*a* of the second vertical tube and the upper portion 13*a*. The grid wall 20 may be secured to the upper support 14 and the lower support 15 by inserting a screw 4, a bolt 5 or a mounting bracket 6 to a pair of slots on the upper support 14*a* and the lower support 15*a* (not shown). One of ordinary skill will appreciate that the grid wall 20 is removable which allows the self-standing merchandise frame 10 to be disassembled during transportation and storage. The upper support 14 and the lower support 15 are configured with at least one slot (14*a* and 15*a*, respectively) for better attachment and securing of the grid wall 20 to the self-standing merchandise frame 10. As shown, upper support 14 and lower support 15 are configured with a first and a second mounting support hooks 16 to engage and support the back of the grid wall 20. The grid wall 20 is configured for attachment of multiple hooks, racks 23, shelves 24, trays, baskets 22 and/or side panels 21 for display different types of merchandise units and for merchandise separation (as shown in FIG. 1F). The grid wall 20 may be constructed of, but not limited to, a metal, such as steel, bronze and aluminum, or a combination therein, or some other solid, durable, hard material, such as plastic or wood, or a combination thereof, without departure from the spirit of the present application as disclosed herein.

Figure 2A:
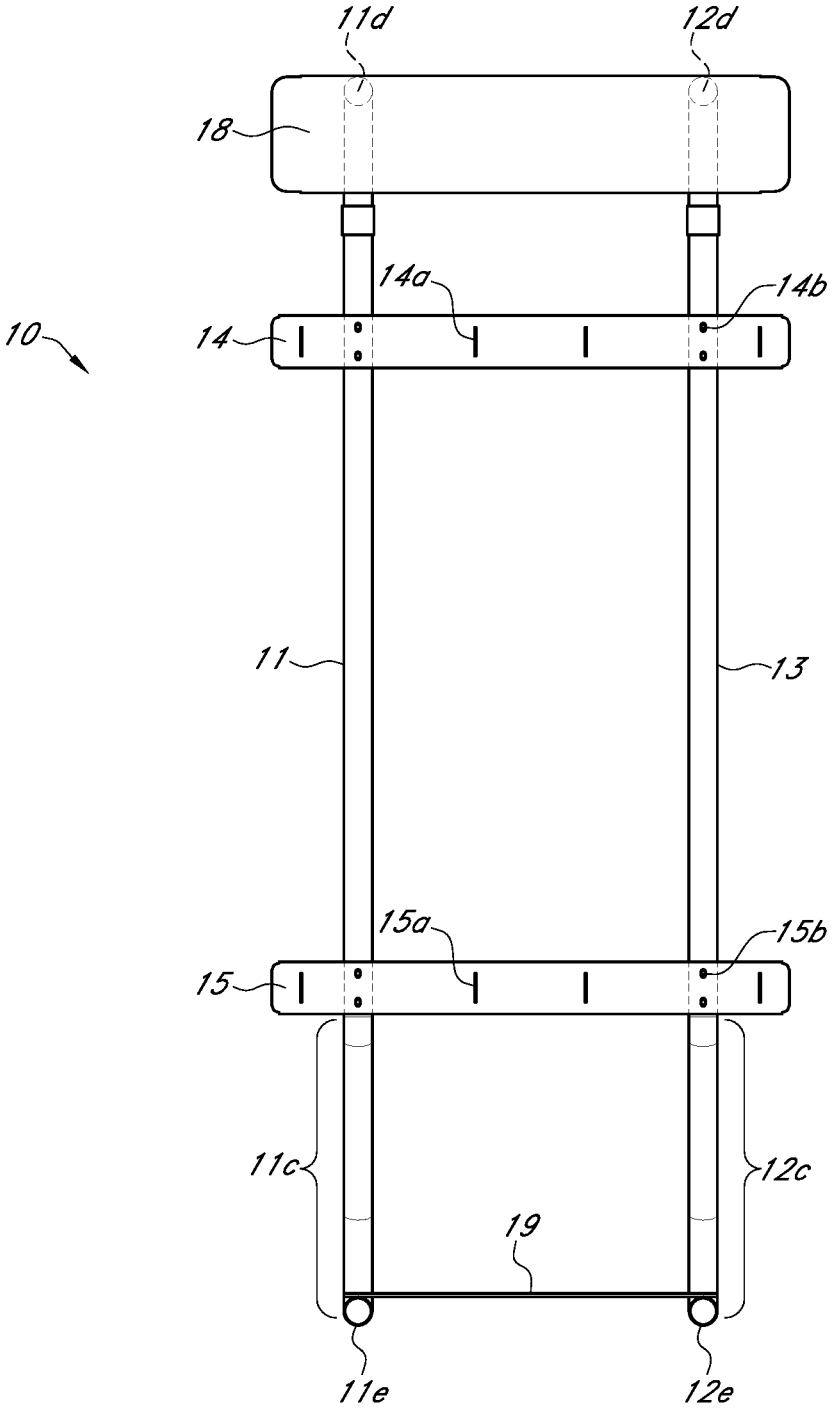
FIG. 2A is a front view of the Self-Standing Merchandise Frame (width of 48 inches) without the grid wall as shown herein.
Figure 2B:
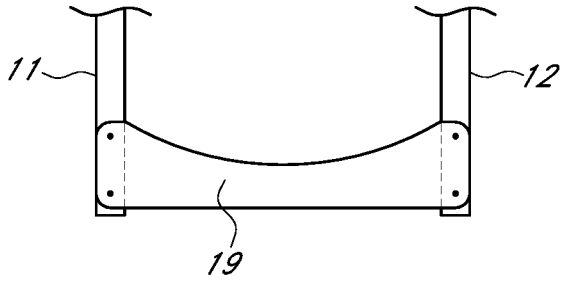
FIG. 2B is a top view of a base plate of the Self-Standing Merchandise Frame positioned on the lower portion of the vertical tubes as shown herein.
Figure 2C:
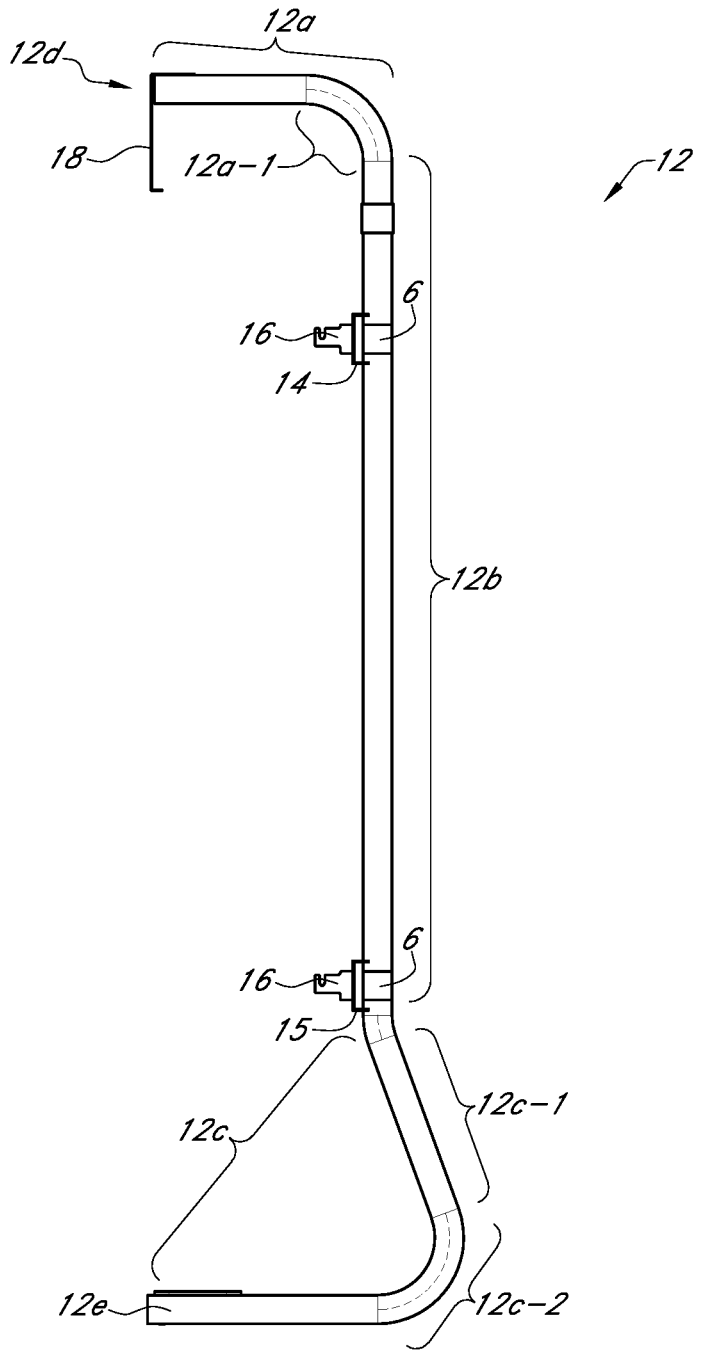
FIG. 2C is a side view of the Self-Standing Merchandise Frame without the grid wall as shown in FIG. 2A herein.
Figure 2D:
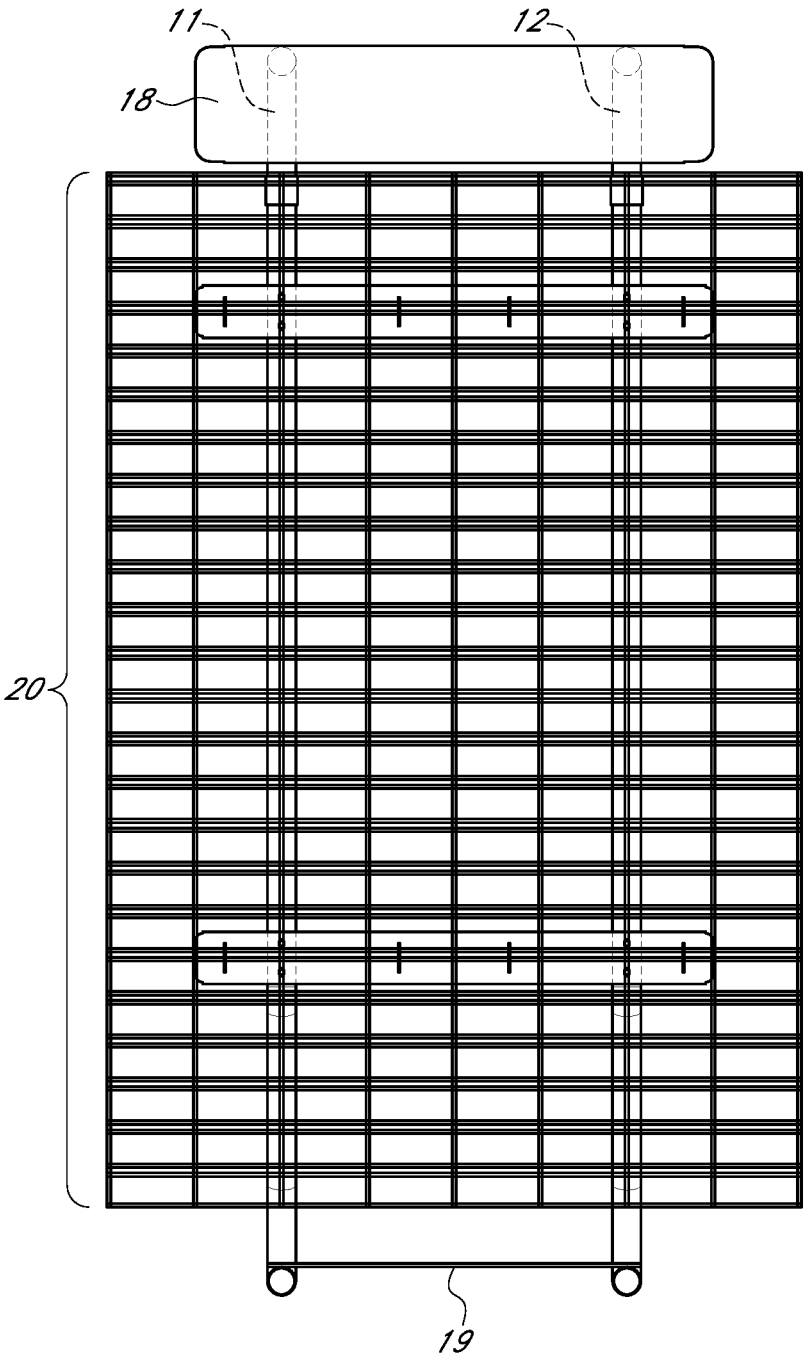
FIG. 2D is a front view of the Self-Standing Merchandise Frame with the grid wall attached to the upper support and the lower support as shown and disclosed.
Figure 2E:
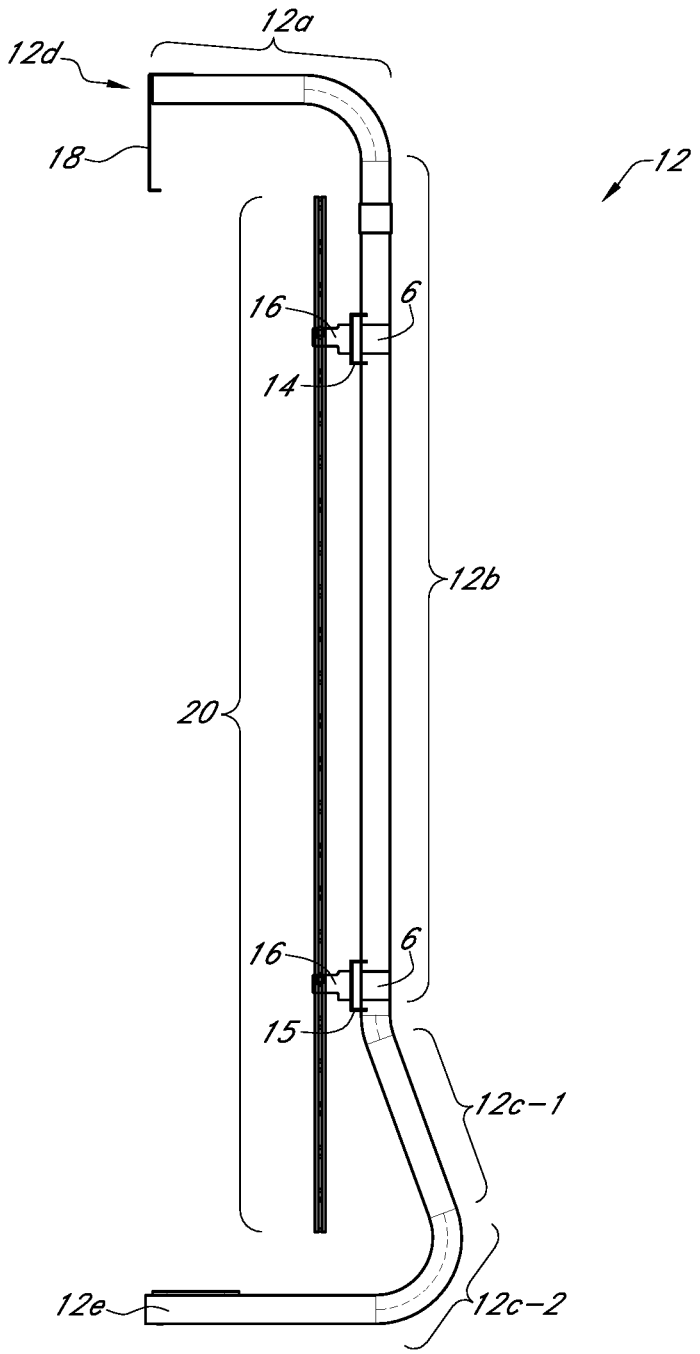
FIG. 2E is a side view of the Self-Standing Merchandise Frame with the grid wall as shown in FIG. 2D herein.
Figure 2F:
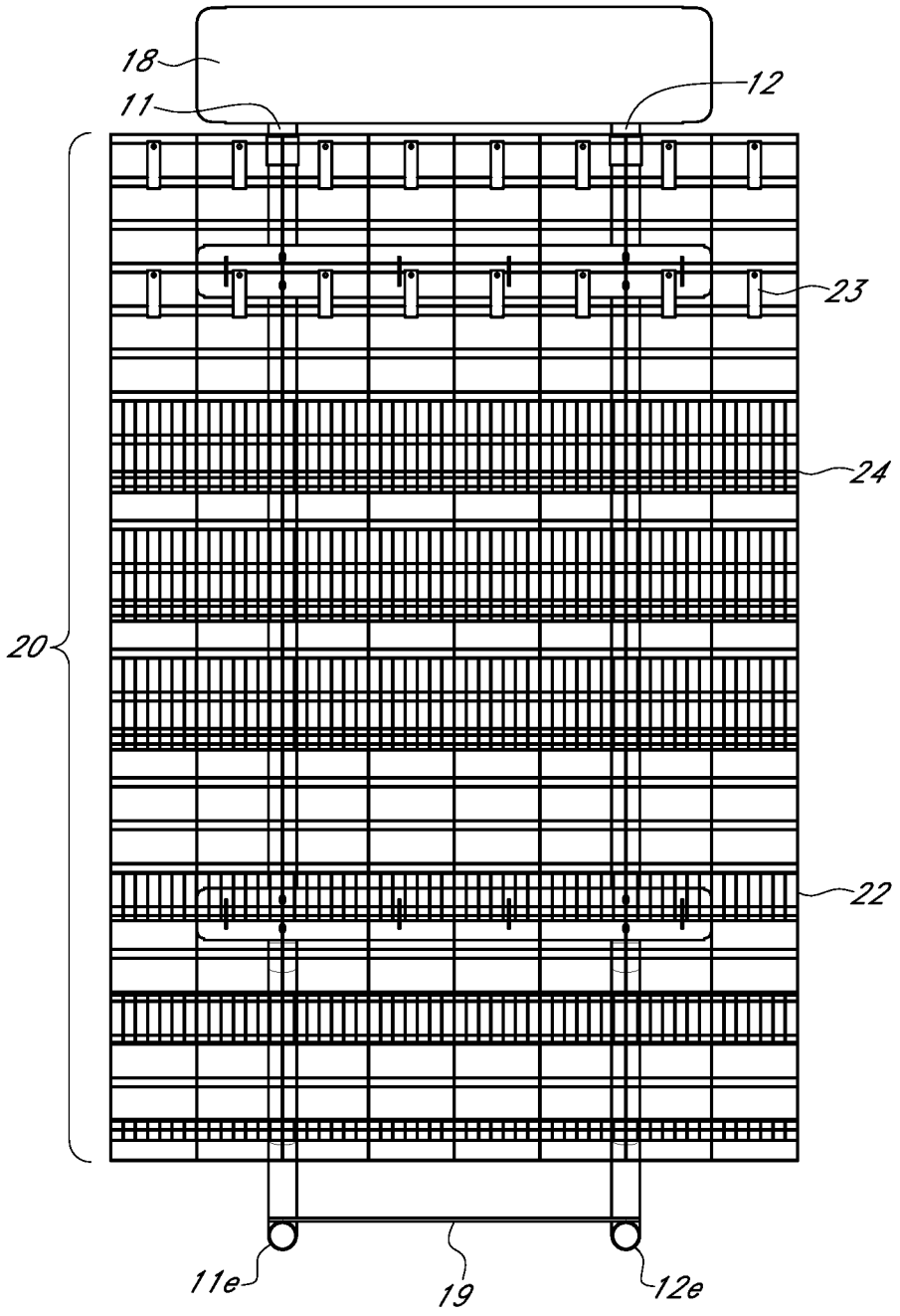
FIG. 2F is a perspective view of the Self-Standing Merchandise Frame with the grid wall as shown in FIG. 2D herein.

FIG. 2A is a front view of the self-standing merchandise frame 10 (width of 48 inches) without the grid wall 20 as shown herein. FIG. 2B is a top view of a base plate 19 of the self-standing merchandise frame 10 positioned on the lower portion of the vertical tubes as shown herein. FIG. 2C is a side view of the self-standing merchandise frame 10 without the grid wall as shown in FIG. 2A herein. FIG. 2D is a front view of the self-standing merchandise frame 10 with the grid wall 20 attached to the upper support 14 and the lower support 15 as shown and disclosed. FIG. 2E is a side view of the self-standing merchandise frame 10 with the grid wall 20 as shown in FIG. 2D herein. FIG. 2F is a perspective view of the self-standing merchandise frame 10 with the grid wall 20 as shown in FIG. 2D herein.

In another embodiment as shown in FIG. 2A-2F, the self-standing merchandise frame 10 is configured with a sign plate 18, an upper support 14, a lower support 15, a first vertical tube 11, a second vertical tube 12 and a base plate 19. As shown, the sign plate 18 is configured to engage with a first end 11*d* of the first vertical tube and a first end 12*d* of the second vertical tube. In one embodiment, the first end of the first 11*d* and the second 12*d* vertical tubes may be positioned to align with the second end of the first 11*e* and the second 12*e* vertical tubes (as shown in FIG. 2C) but in another embodiment, it may be constructed to be positioned proximate the vertical tubes for a better merchandise display (not shown). The first vertical tube 11 is configured with an upper portion 11*a*, a middle portion 11*b* and a lower portion 11*c* wherein the upper portion 11*a* of the first vertical tube is configured to engage with the sign plate 18 and the lower portion 11*c* of the first vertical tube is configured to engage with the base plate 19. The middle portion 11*b* of the first vertical tube has an upper curved radius 11*a*-1 transiting to the upper portion 11*a* of the first vertical tube and a lower curved radius 11*c*-2 transiting to the lower portion 11*c* of the first vertical tube. The second vertical tube 12 is configured with an upper portion 12*a*, a middle portion 12*b* and a lower portion 12*c* wherein the upper portion 12*a* of the second vertical tube 12 is configured to engage with the sign plate 18 and the lower portion 12*c* of the second vertical tube 12 is configured to engage with the base plate 19. The middle portion 12*b* of the second vertical tube 12 has an upper curved radius 12*a*-1 transiting to the upper portion 12*a* of the second vertical tube 12 and a lower curved radius 12*c*-2 transiting to the lower portion 12*c* of the second vertical tube 12. The lower portion 12*c* of the first vertical tube 11 and the second vertical tube 12 are configured to engage with the floor or ground surface 27 (not shown) and provide structural support for the self-standing merchandise frame 10. The base plate 19 is configured to engage with and be positioned on top of the lower portion of the first 11 and the second 12 vertical tubes for securement to provide further structural support to the entire merchandise frame 10.

The upper portion 11*a* of the first vertical tube (see FIG. 1C) is parallel with the lower portion 11*c* of the first vertical tube to provide the balance and more structural support to the merchandise frame 10. Dependent on the particular application, the angle between the upper portion 11*a* and the lower portion 11*c* of the first vertical tube may be customized between the range of 0 degree (same direction with each other) to 180 degrees (opposite direction with each other), without any limitation and or restriction. The upper portion 12*a* of the second vertical tube (as shown in FIG. 2C) is parallel with the lower portion 12*c* of the second vertical tube to improve the balance and provide structural support to the frame. As shown in FIGS. 2A-2F, the angle between the upper portion 11*a* of the first vertical tube and the lower portion 11*c* of the first vertical tube is 0 (zero) degrees. Dependent on the particular application, the angle between the upper portion 12*a* and the lower portion 12*c* of the second vertical tube 12 may be customized between the range of 0 degree (same direction with each other) to 180 degrees (opposite direction with each other), without any limitation and or restriction. As shown in FIGS. 2A-2F, the angle between the upper portion 12*a* of the second vertical tube and the lower portion 12*c* of the second vertical tube is 0 (zero) degrees.

As shown in FIG. 2C, the angle of the upper curved radius 12*a*-1 and the lower curved radius 12*c*-2 of the second vertical tube is approximately 160 degrees but not limited to any value between a range of 100-360 degrees. The radius of the upper curved radius 12*a*-1 and the lower curved radius 12*c*-2 of the second vertical tube is approximately 5 inches, but not limited to any value between a range of 4-10 inches. As shown in FIG. 1C, the angle of the upper curved radius 11*a*-1 and the lower curved radius 11*c*-2 of the first vertical tube is approximately 160 degrees but not limited to any value between a range of 100-360 degrees. The radius of the upper curved radius 11*a*-1 and the lower curved radius 11*c*-2 of the first vertical tube is approximately 5 inches, but not limited to any value between a range of 4-10 inches. One of ordinary skill will appreciate that the angle and the radius of the upper curved radius (11*a*-1, 12*a*-1, 13*a*-1, respectively) and the lower curved radius (11*c*-2, 12*c*-2, 13*c*-2, respectively) of each vertical tube can be customized to as suitable for a particular application to support the self-standing of the embodiment without any limitation and/or restriction unless otherwise indicated in the following claims.

The upper support 14 and the lower support 15 are configured for attachment along the length of the first 11 and the second 12 vertical tubes. The upper support 14 is configured for horizontal attachment to the upper portion 11*a* of the first vertical tube and the upper portion 12*a* the second vertical tubes. The upper support 14 may be secured to the first 11 and the second 12 vertical tubes by inserting a screw 4, a bolt 5 or a mounting bracket 6 to at least one hole 11*f* on the first vertical tube 11 and at least one hole 12*f* on the second vertical tube 12. The upper support 14 positions proximately to the upper curved radius (11*a*-1, 12*a*-1, respectively) of the first and the second vertical tubes. The lower support 15 is configured for horizontal attachment between the first 11 and the second 12 vertical tubes. The lower support 15 may be secured to the first 11 and the second 12 vertical tubes by inserting a screw 4, a bolt 5 or a mounting bracket 6 to at least one hole on the first 11*f* and the second 12*f* vertical tubes. The lower support 15 positions proximately to the lower curved radius of the first 11*c*-2 and the second 12*c*-2 vertical tubes. One of ordinary skill will appreciate that the upper support 14 and the lower support 15 are removable which allows the self-standing merchandise frame 10 to be disassembled during transportation and storage. One of ordinary skill will also appreciate that each vertical tube is configured of at least two holes (11*f*, 12*f*, 13*f*, respectively) along the length of each of the vertical tube which allows the upper support 14 and the lower support 15 to be adjustable in height. One of ordinary skill will appreciate that the embodiments disclosed herein may also be produced to have the various elements permanently affixed, i.e. welding the horizontal supports to the vertical tubes (not shown), or producing the various components using a one-piece integral type construction from either metal or plastic (not shown), as suitable to a particular application, without departure from the spirit of the application as disclosed herein.

Another feature of the embodiment is the grid wall 20 (as shown in FIGS. 2D-2F). The grid wall 20 is configured for attachment to and between the upper support 14 and the lower support 15 wherein the upper support 14 and the lower support 15 are attached to the first 11 and the second 12 vertical tubes. The grid wall 20 may be secured to the upper support 14 and the lower support 15 by inserting a screw 4, a bolt 5 or a mounting bracket 6 to at least one slot 14*a* on the upper support and at least one slot 15*a* on the lower support. One of ordinary skill will appreciate that the grid wall 20 is removable which allows the self-standing merchandise frame 10 to be disassembled during transportation and storage. The upper support 14 and the lower support 15 are configured with at least one slot (14*a* and 15*a*, respectively) for better attachment and securing of the grid wall 20 to the self-standing merchandise frame 10. The grid wall 20 is configured for attachment of multiple racks 23, shelfs 24, baskets 22 and side panels 21 for display different types of merchandise units and merchandise separation (as shown in FIG. 2F). The grid wall 20 may be constructed of, but not limited to, a metal, such as steel, bronze and aluminum, or a combination therein, or some other solid, durable, hard material, such as plastic or wood, or a combination thereof, without departure from the spirit of the present application as disclosed herein.

Figure 3A:
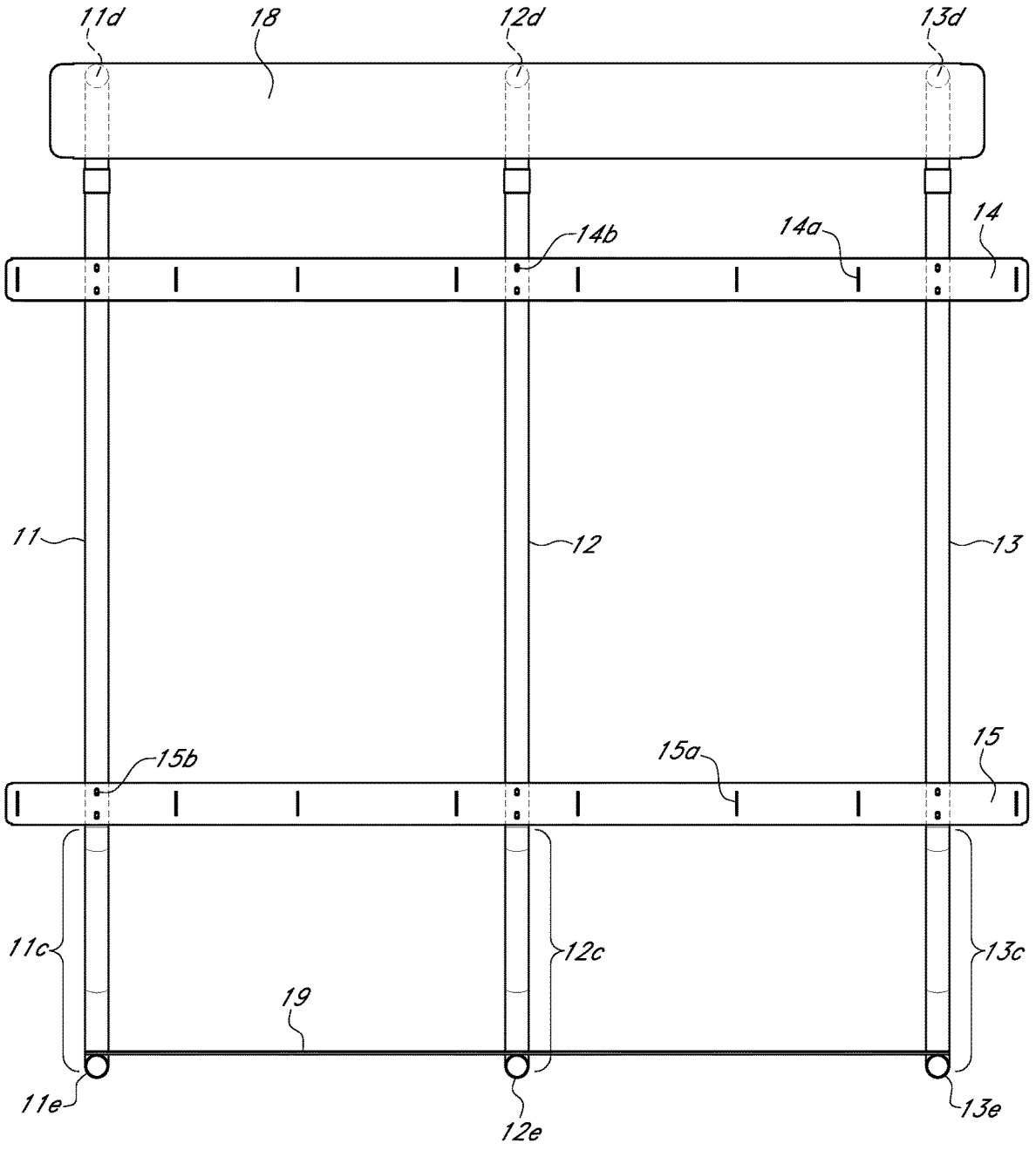
FIG. 3A is a front view of the Self-Standing Merchandise Frame (width of 96 inches) without the grid wall as shown herein.
Figure 3B:
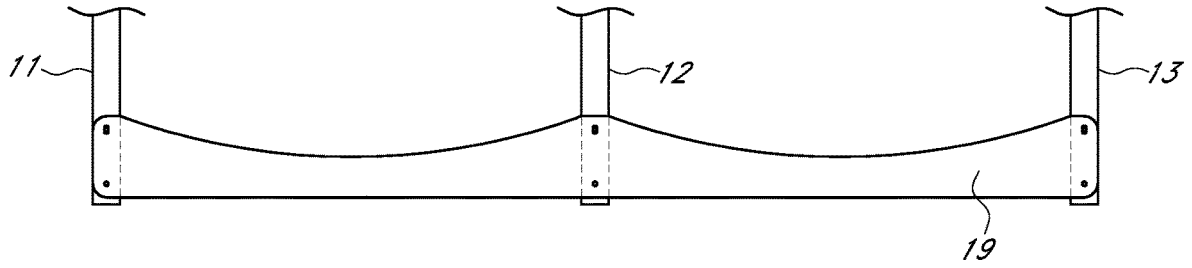
FIG. 3B is a top view of a base plate of the Self-Standing Merchandise Frame positioned on the lower portion of the vertical tubes as shown herein.
Figure 3C:
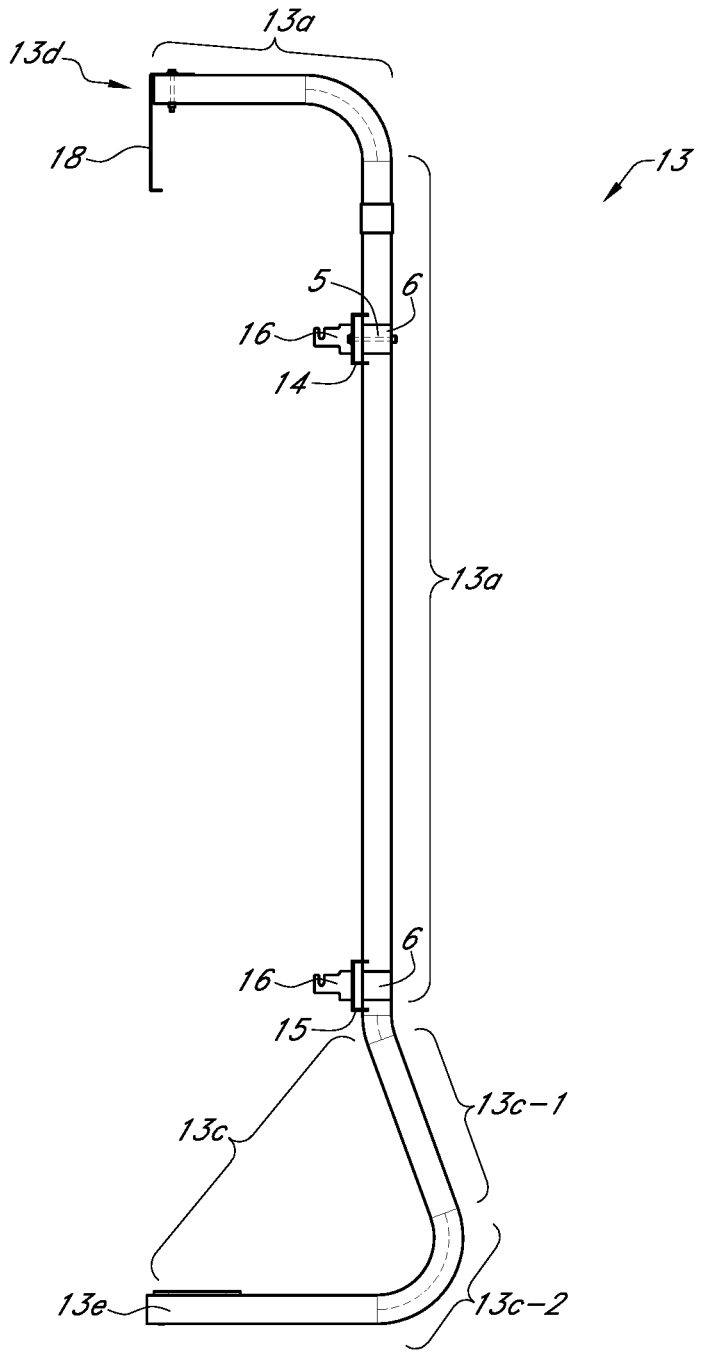
FIG. 3C is a side view of the Self-Standing Merchandise Frame without the grid wall as shown in FIG. 3A herein.
Figure 3D:
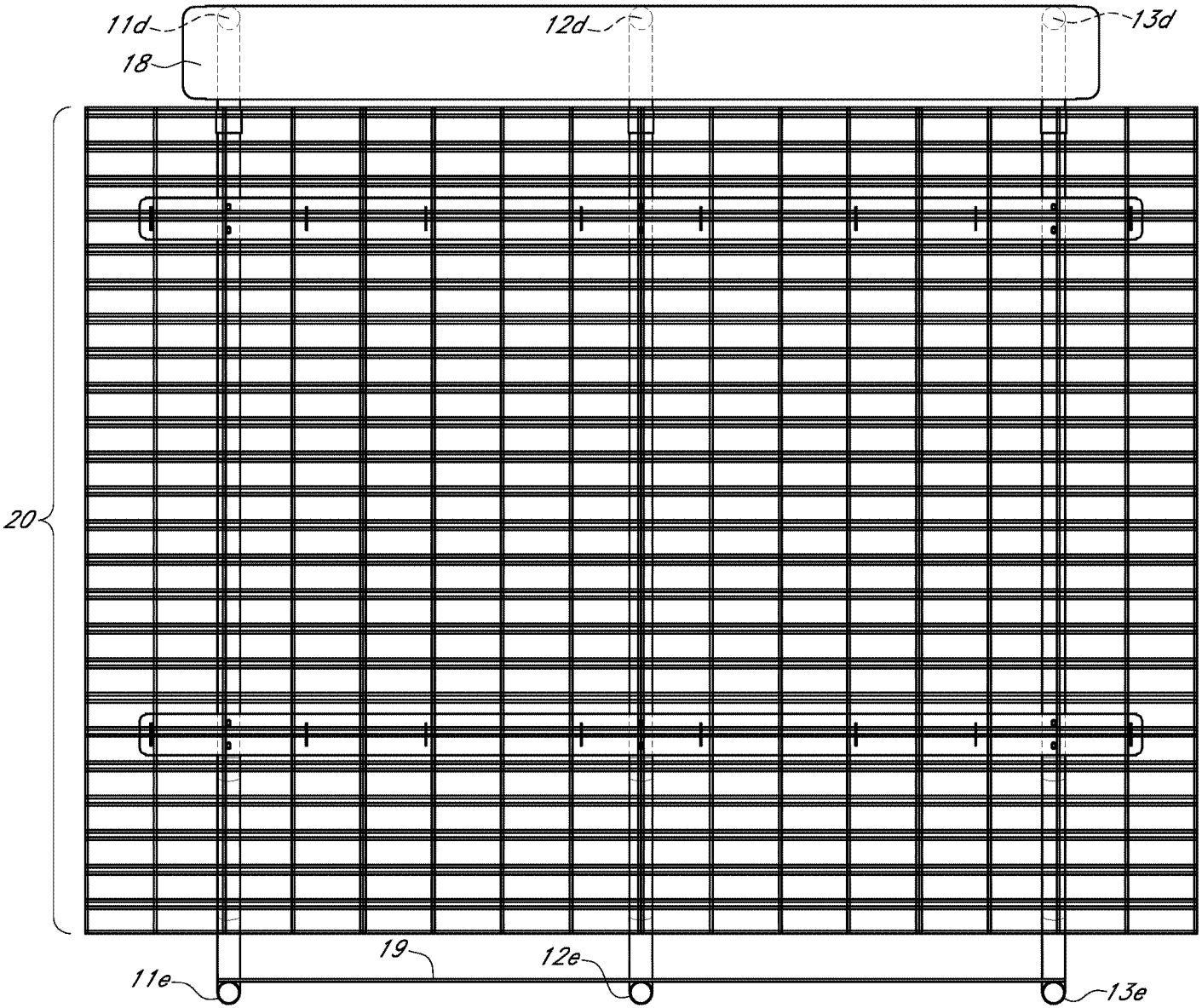
FIG. 3D is a front view of the Self-Standing Merchandise Frame with the grid wall attached to the horizontal tubes as shown and disclosed.
Figure 3E:
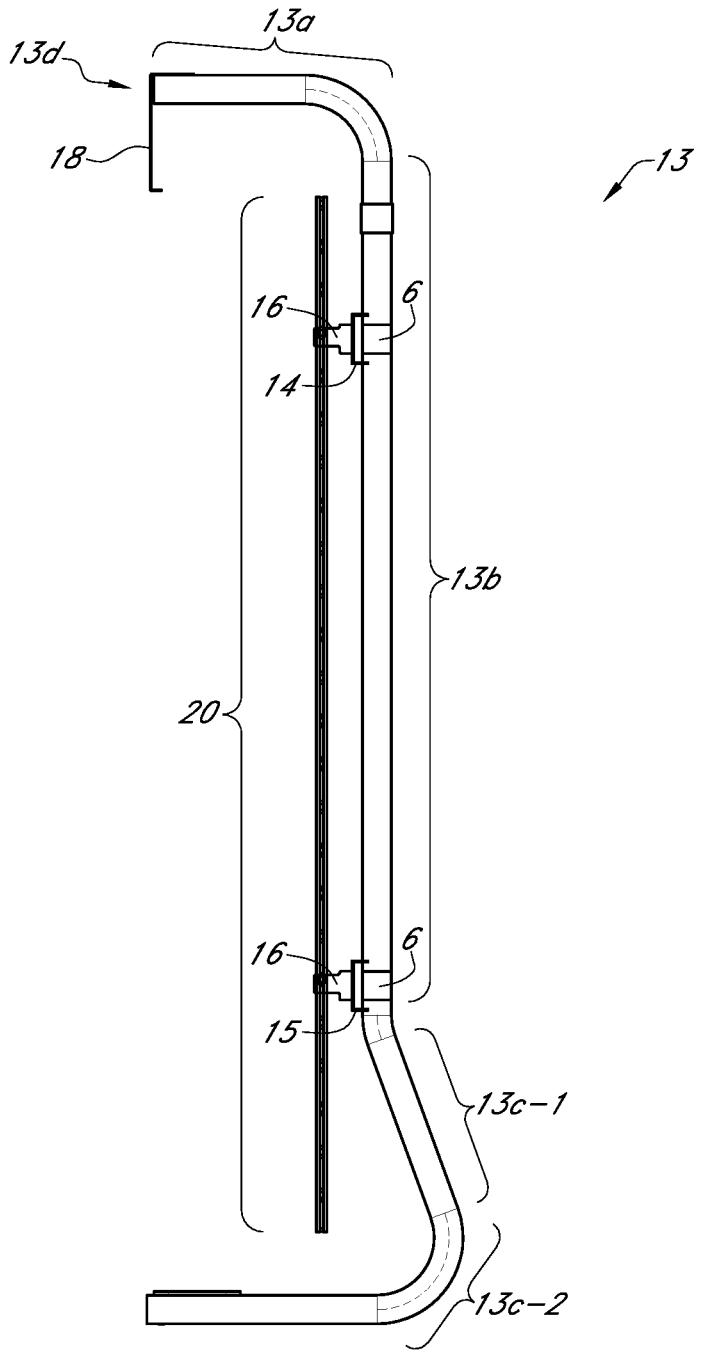
FIG. 3E is a side view of the Self-Standing Merchandise Frame with the grid wall as shown in FIG. 3D herein.
Figure 3F:
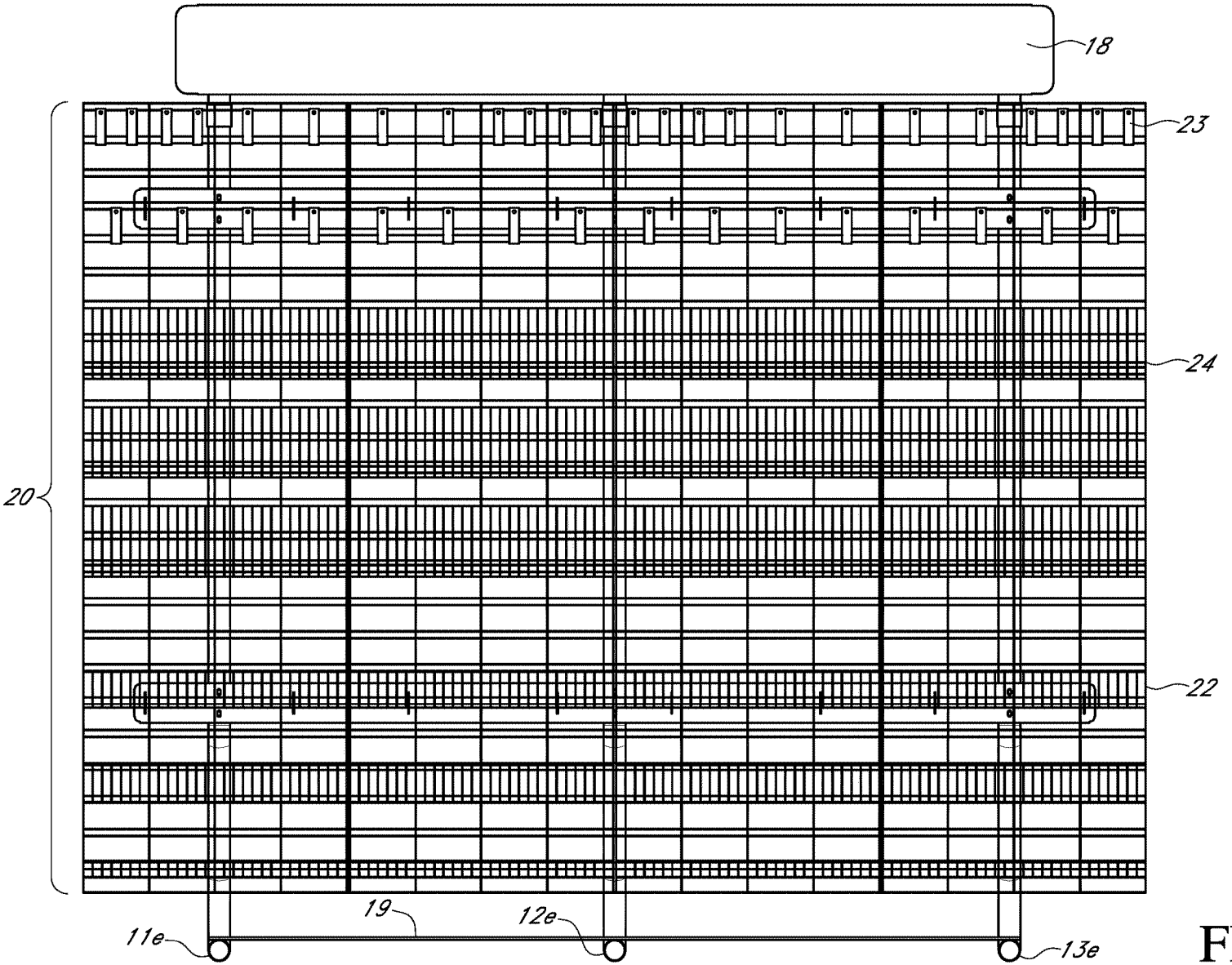
FIG. 3F is a perspective view of the Self-Standing Merchandise Frame with the grid wall as shown in FIG. 3D herein.

FIG. 3A is a front view of the self-standing merchandise frame 10 (width of 96 inches) without the grid wall 20 as shown herein. FIG. 3B is a top view of a base plate 19 of the self-standing merchandise frame 10 positioned on the lower portion of the vertical tubes as shown herein. FIG. 3C is a side view of the self-standing merchandise frame 10 without the grid wall 20 as shown in FIG. 3 herein. FIG. 3D is a front view of the Self-standing merchandise frame 10 with the grid wall 20 attached to the upper support 14 and the lower support 15 as shown and disclosure. FIG. 3E is a side view of the self-standing merchandise frame 10 with the grid wall 20 as shown in FIG. 3C herein. FIG. 3F is a perspective view of the self-standing merchandise frame 10 with the grid wall 20 as shown in FIG. 3C herein.

In another embodiment as shown in FIG. 3A-3F, the self-standing merchandise frame 10 is configured of a sign plate 18, an upper support 14, a lower support 15, a first vertical tube 11, a second vertical tube 12, a third vertical tube 13 and a base plate 19. As shown, the sign plate 18 is configured to engage with a first end of the first 11*d*, the second 12*d* and the third 13*c* vertical tubes. In one embodiment, the first end of the first 11, the second 12 and the third 13 vertical tubes may be positioned to align with the second end of the first 11*e*, the second 12*e* and the third 13*e* vertical tubes (as shown in FIG. 3C) but in another embodiment, it may be constructed to position proximately toward the vertical tubes for a better merchandise display 2 (not shown). The first vertical tube 11 is configured of an upper portion 11*a*, a middle portion 11*b* and a lower portion 11*c* wherein the upper portion 11*a* of the first vertical tube is configured to engage with the sign plate 18 and the lower portion 11*c* of the first vertical tube is configured to engage with the base plate 19. The middle portion 11*b* of the first vertical tube has an upper curved radius 11*a*-1 transiting to the upper portion lla of the first vertical tube and a lower curved radius 11*c*-2 transiting to the lower portion 11*c* of the first vertical tube. The second vertical tube 12 is configured of an upper portion 12*a*, a middle portion 12*b* and a lower portion 12*c* wherein the upper portion 12*a* of the second vertical tube is configured to engage with the sign plate 18 and the lower portion 12*c* of the second vertical tube is configured to engage with the base plate 19. The middle portion 12*b* of the second vertical tube has an upper curved radius 12*a*-1 transiting to the upper portion 12*a* of the second vertical tube and a lower curved radius 12*c*-2 transiting to the lower portion 12*c* of the second vertical tube. The third vertical tube 13 is configured of an upper portion 12*a*, a middle portion 12*b* and a lower portion 12*c* wherein the upper portion 12*a* of the second vertical tube is configured to engage with the sign plate 18 and the lower portion 13*c* of the third vertical tube is configured to engage with the base plate 19. The middle portion 13*b* of the third vertical tube has an upper curved radius 13*a*-1 transiting to the upper portion 13*a* of the third vertical tube and a lower curved radius 13*c*-2 transiting to the lower portion 13*c* of the third vertical tube. The lower portion 13*c* of the first 11, the second 12 and the third 13 vertical tubes is configured to engage with the floor surface (not shown) 27 to provide structural support for the self-standing merchandise frame 10. The base plate 19 is configured to engage with and position on top of the lower portion of the first 11*c*, the second 12*c* and the third 13*c* vertical tubes to secure and provide further structural support to the entire embodiment.

As shown in FIG. 1C, the upper portion 11*a* of the first vertical tube is parallel with the lower portion 11*c* of the first vertical tube to provide the balance and more structural support to the merchandise frame 10. Dependent on the particular application, the angle between the upper portion 11*a* and the lower portion 11*c* of the first vertical tube 11 may be customized between the range of 0 degree (same direction with each other) to 180 degrees (opposite direction with each other), without any limitation and or restriction. As shown in FIG. 2C, the upper portion 12*a* of the second vertical tube (not shown) is parallel with the lower portion 12*c* of the second vertical tube to provide more balance and more structural support to the frame. Dependent on the particular application, the angle between the upper portion 12*a* and the lower portion 12*c* of the second vertical tube may be customized between the range of 0 degree (same direction with each other) to 180 degrees (opposite direction with each other), without any limitation and or restriction. As shown in FIG. 3C, the upper portion 13*a* of the third vertical tube (not shown) is parallel with the lower portion 13*c* of the third vertical tube to provide more balance and more structural support to the merchandise frame 10. Dependent on the particular application, the angle between the upper portion 13*a* and the lower portion 13*c* of the third vertical tube may be customized between the range of 0 degree (same direction with each other) to 180 degrees (opposite direction with each other), without any limitation and or restriction.

As shown in FIG. 3C, the angle of the upper curved radius 11*a*-1 and the lower curved radius 11*c*-2 of the first vertical tube 11 is approximately 160 degrees but not limited to any value between a range of 100-360 degrees. The radius of the upper curved radius 11*a*-1 and the lower curved radius 11*c*-2 of the first vertical tube is approximately 5 inches, but not limited to any value between a range of 4-10 inches. The angle of the upper curved radius 12*a*-1 and the lower curved radius 12*c*-2 of the second vertical tubes is approximately 160 degrees but not limited to any value between a range of 100-360 degrees. The radius of the upper curved radius 12*a*-1 and the lower curved radius 12*c*-2 of the second vertical tube 12 is approximately 5 inches, but not limited to any value between a range of 4-10 inches. The angle of the upper curved radius 13*c*-1 and the lower curved radius 13*c*-2 of the third vertical tubes is approximately 160 degrees but not limited to any value between a range of 100-360 degrees. The radius of the upper curved radius 13*a*-1 and the lower curved radius 13*c*-2 of the third vertical tubes is approximately 5 inches, but not limited to any value between a range of 4-10 inches. One of ordinary skill will appreciate that the angle and the radius of the upper curved radius and the lower curved radius of each vertical tube can be customized to provide flexibility and structural support the self-standing of the embodiment without any limitation and/or restriction unless otherwise indicated in the following claims.

The upper support 14 and the lower support 15 are configured for attachment along the length of the first 11, the second 12 and the third 13 vertical tubes. The upper support 14 is configured for horizontal attachment to the lower portion of the first 11*c*, the second 12*c* and the third 13*c* vertical tubes. The upper support 14 may be secured to the first 11, the second 12 and the third 13 vertical tubes by inserting a screw 4, a bolt 5 or a mounting bracket 6 to at least one hole (11*f*, 12*f*, 13*f*, respectively) on the first, the second and the third vertical tube. As shown in FIG. 3C, the upper support 14 and the lower support 15 are attached to the first 11, the second 12 and the third 13 vertical tubes via a bolt 5. The upper support 14 positions proximately to the upper curved radius of the first 11*a*-1, the second 12*a*-1 and the third 13*a*-1 vertical tubes. The lower support 15 is configured for horizontal attachment between the first 11, the second 12 and the third 13 vertical tubes. The lower support 15 may be secured to the first 11, the second 12 and the third 13 vertical tubes by inserting a screw 4, a bolt 5 or a mounting bracket 6 to at least one hole (11*f*, 12*f*, 13*f*, respectively) on each of the first, the second and the third vertical tubes. The lower support 15 positions proximately to the lower curved radius of the first 11*c*-2, the second 12*c*-2 and the third 13*c*-2 vertical tubes. One of ordinary skill will appreciate that the upper support 14 and the lower support 15 are removable which allows the self-standing merchandise frame 10 to be disassembled during transportation and storage. One of ordinary skill will also appreciate that each vertical tube is configured of at least two holes (11*f*, 12*f*, 13*f*, respectively) along the length of each of the vertical tubes which allows the upper support 14 and the lower support 15 to be adjustable in height. One of ordinary skill will appreciate that the embodiments disclosed herein may also be produced to have the various elements permanently affixed, i.e. welding the upper support 14 and the lower support 15 to the vertical tubes (not shown), or producing the various components using a one-piece integral type construction from either metal or plastic (not shown), as suitable to a particular application, without departure from the spirit of the application as disclosed herein.

Another feature of the embodiment is the grid wall 20 (as shown in FIGS. 3D-3F). The grid wall 20 is configured for attachment to and between the upper support 14 and the lower support 15 wherein the upper support 14 and the lower support 15 are attached to the first 11, the second 12 and the third 13 vertical tubes. The grid wall 20 may be secured to the upper support 14 and the lower support 15 by inserting a screw 4, a bolt 5 or a mounting bracket 6 to a pair of slots on the upper support 14 and the lower support 15. One of ordinary skill will appreciate that the grid wall 20 is removable which allows the self-standing merchandise frame 10 to be disassembled during transportation and storage. The upper support 14 and the lower support 15 are configured with at least one slot (14*a* and 15*a*, respectively) for better attachment and securing of the grid wall 20 to the self-standing merchandise frame 10. The grid wall 20 is configured for attachment of multiple hooks 17, racks 23, shelves 24, trays, baskets 22 and/or side panels 21 for display different types of merchandise units and for merchandise separation (as shown in FIG. 3F). The grid wall 20 may be constructed of, but not limited to, a metal, such as steel, bronze and aluminum, or a combination therein, or some other solid, durable, hard material, such as plastic or wood, or a combination thereof, without departure from the spirit of the present application as disclosed herein.

Dependent on the specific application, the self-standing merchandise frame 10 may be customized and/or configured in a variety of manners. For instance, the height, width, thickness, shape, configuration, etc. of the vertical tube, the upper support 14, the lower support 15, the sign plate 18, the base plate 19 and the grid wall 20 may vary from one embodiment of the self-standing merchandise frame 10 to the next without any limitation and/or restriction unless otherwise indicated in the following claims.

In addition, dependent on the specific application, the number of the vertical tubes may be increased or decreased to fit with different sizes of the grid wall 20. Although not shown, in one embodiment, an extender arm 30 may be attached to the grid wall 20, the vertical tube, the upper support 14, or the lower support 15 or a combination thereof for the purpose of extending the size of the self-standing merchandise frame 10 without disassembling and or remodeling the entire embodiment.

Figure 4A:
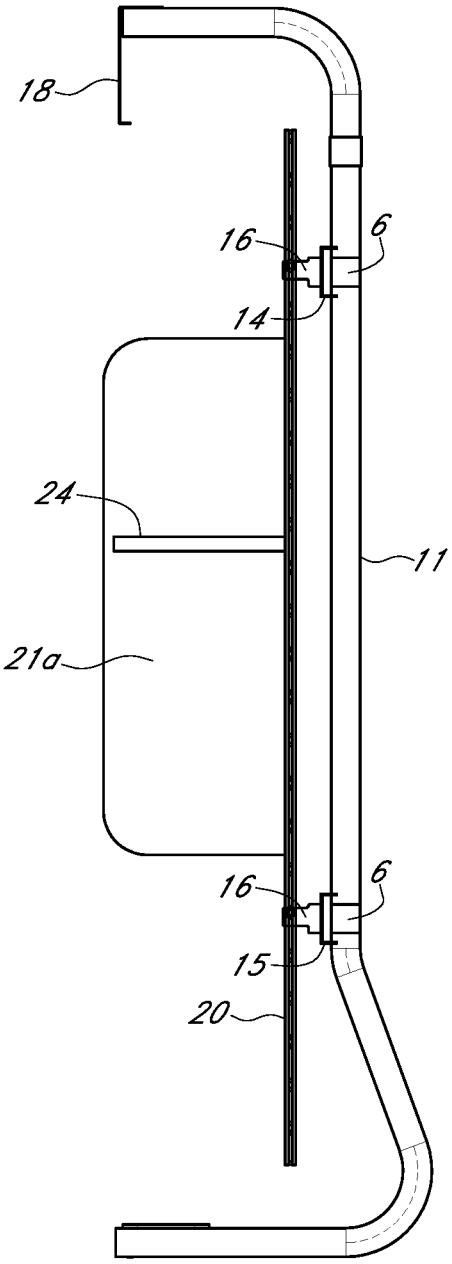
FIG. 4A is a side perspective view of a small side panel in full extension positioned in the middle portion of the Self-Standing Merchandise Frame as shown and disclosed herein.
Figure 4B:
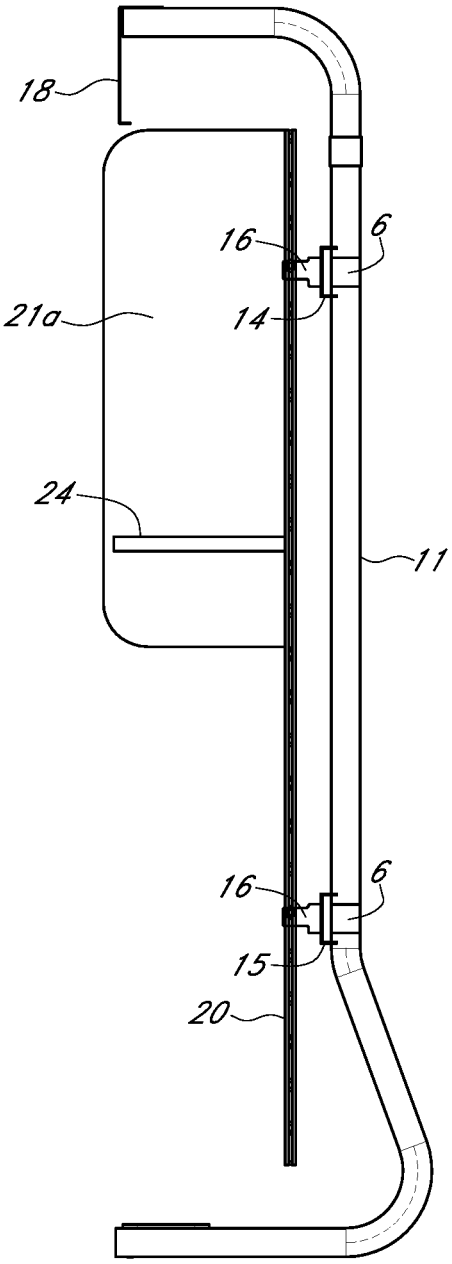
FIG. 4B is a side perspective view of a small side panel in full extension positioned in the upper portion of the Self-Standing Merchandise Frame as shown and disclosed herein.
Figure 4C:
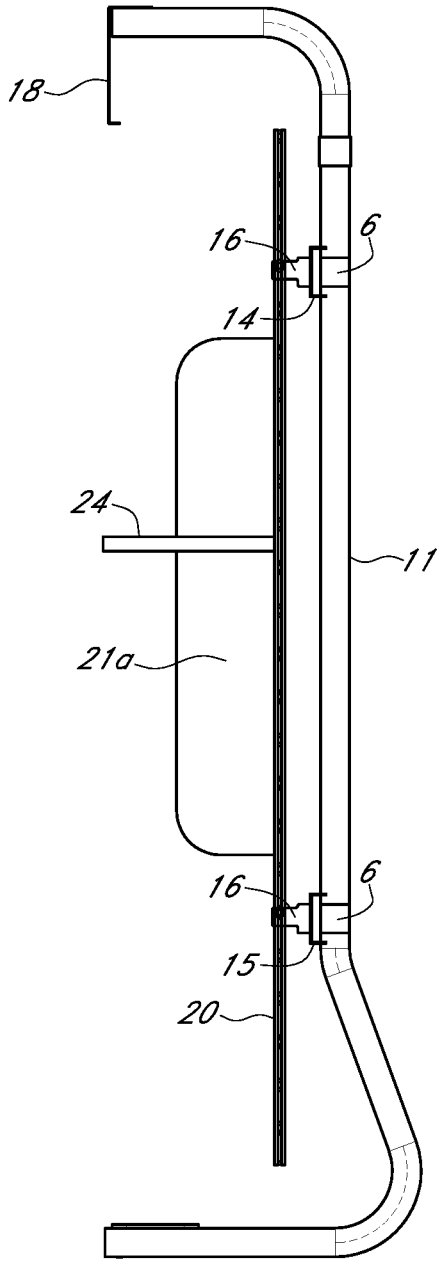
FIG. 4C is a side perspective view of a small side panel in half extension positioned in the middle portion of the Self-Standing Merchandise Frame as shown and disclosed herein.
Figure 4D:
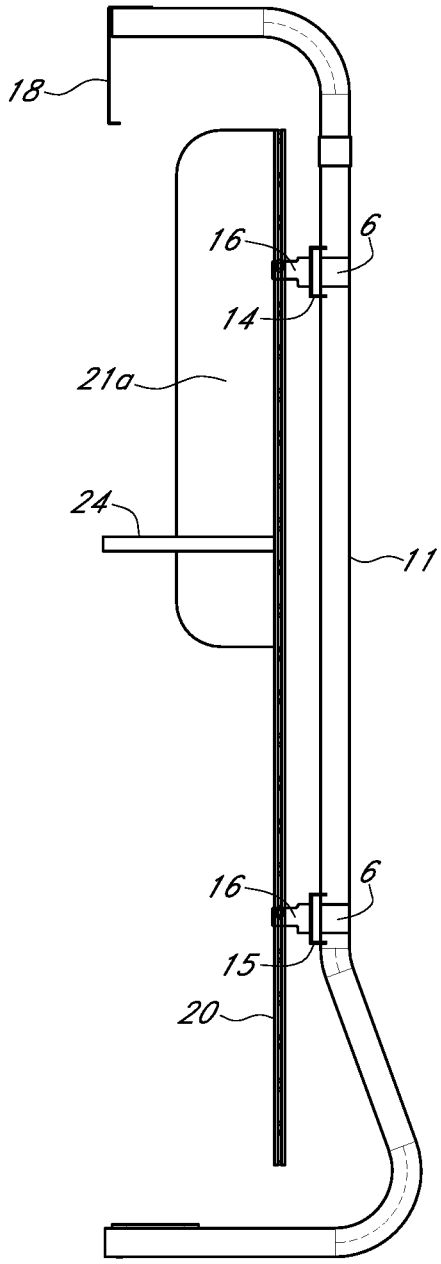
FIG. 4D is a side perspective view of a small side panel in half extension positioned in the upper portion of the Self-Standing Merchandise Frame as shown and disclosed herein.

Another feature of the present embodiment, as shown in FIGS. 4A-6B, is the side panel 21. As shown, FIG. 4A is a side perspective view of a small side panel 21*a* in full extension positioned in the middle portion 20*a* of the grid wall as shown and disclosed herein. FIG. 4B is a side perspective view of a small side panel 21*a* in full extension positioned in the upper portion 20*a* of the grid wall as shown and disclosed herein. FIG. 4C is a side perspective view of a small side panel 21*a* in half extension positioned in the middle portion 20*b* of the grid wall as shown and disclosed herein. FIG. 4D is a side perspective view of a small side panel 21*a* in half extension positioned in the upper portion 20*a* of the grid wall as shown and disclosed herein.

As shown in FIGS. 4A-4D, the small side panel 21*a* is configured for attachment along the length of the grid wall 20. The small side panel 21*a* may be attached and positioned along the length of the grid wall 20 via a screw, a bolt or a mounting bracket 16. Due to the small size, the small side panel 21*a* (in full extension) may be attached to an upper portion 20*a* (see FIG. 4B), a middle portion 20*b* (see FIG. 4A) or a lower portion 20*c* (not shown) of the grid wall. In one embodiment, the small side panel 21*a* (in half extension) may be attached to an upper portion 20*a* (see FIG. 4D), a middle portion 20*b* (see FIG. 4C) or a lower portion 20*c* (not shown) of the grid wall. The small side panel 21*a* is designed for multiple purposes such as merchandise separation, decoration, advertisement, etc. The small side panel 21*a* is removable, light and adjustable which makes it easy to use, with transportation and storage convenient for the operator. One of ordinary skill will appreciate that the small side panel can be adjusted and be positioned along the length (vertical) of the grid wall. One of ordinary skill will also appreciate that the small side panel 21*a* can be adjusted and be positioned along the width (horizontal dimension) of the grid wall 20, without any limitation and/or restriction unless otherwise indicated in the following claims.

Figure 5A:
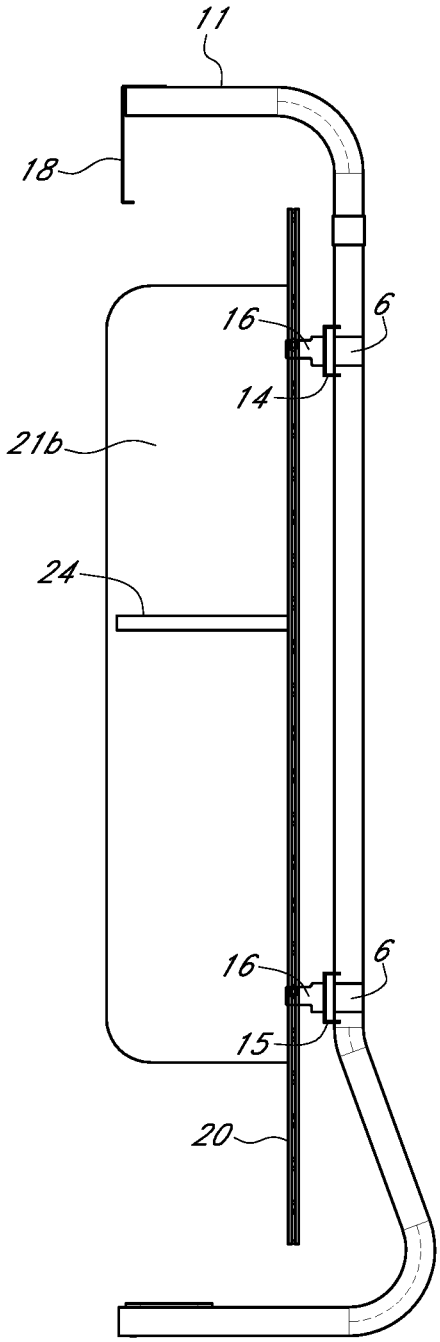
FIG. 5A is a side perspective view of a medium side panel in full extension positioned in the middle portion of the Self-Standing Merchandise Frame as shown and disclosed herein.
Figure 5B:
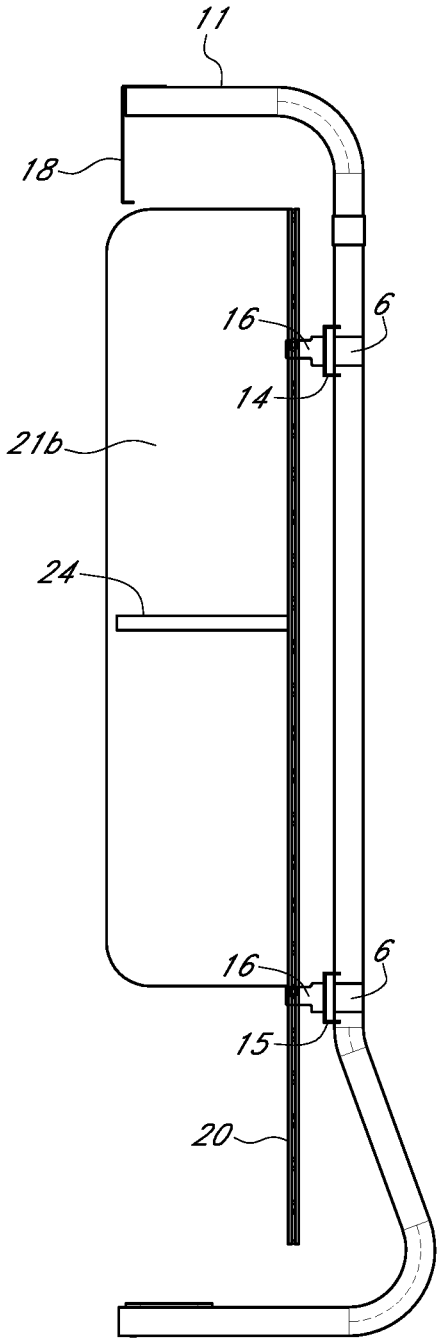
FIG. 5B is a side perspective view of a medium side panel in full extension positioned in the upper portion of the Self-Standing Merchandise Frame as shown and disclosed herein.
Figure 5C:
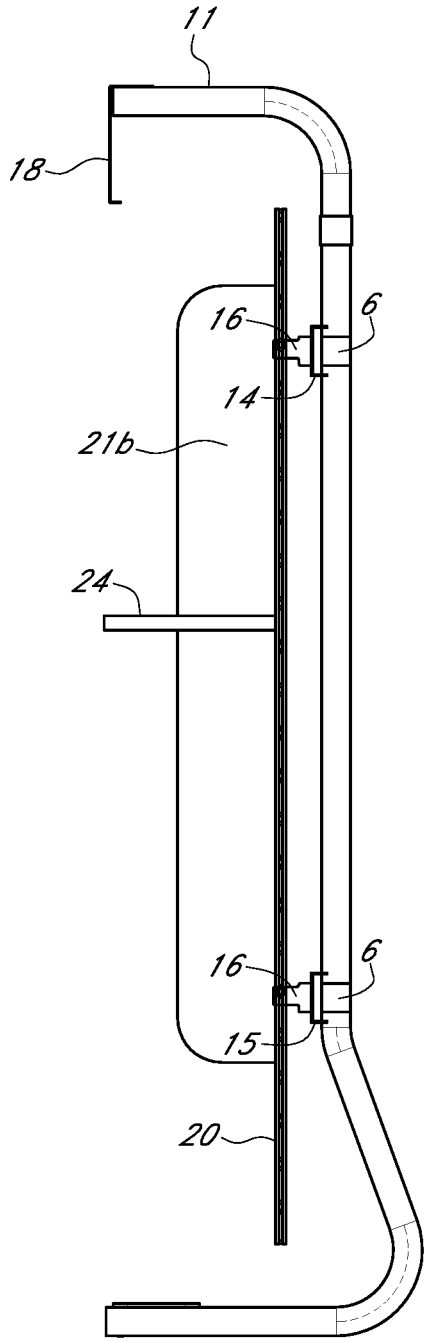
FIG. 5C is a side perspective view of a medium side panel in half extension positioned in the middle portion of the Self-Standing Merchandise Frame as shown and disclosed herein.
Figure 5D:
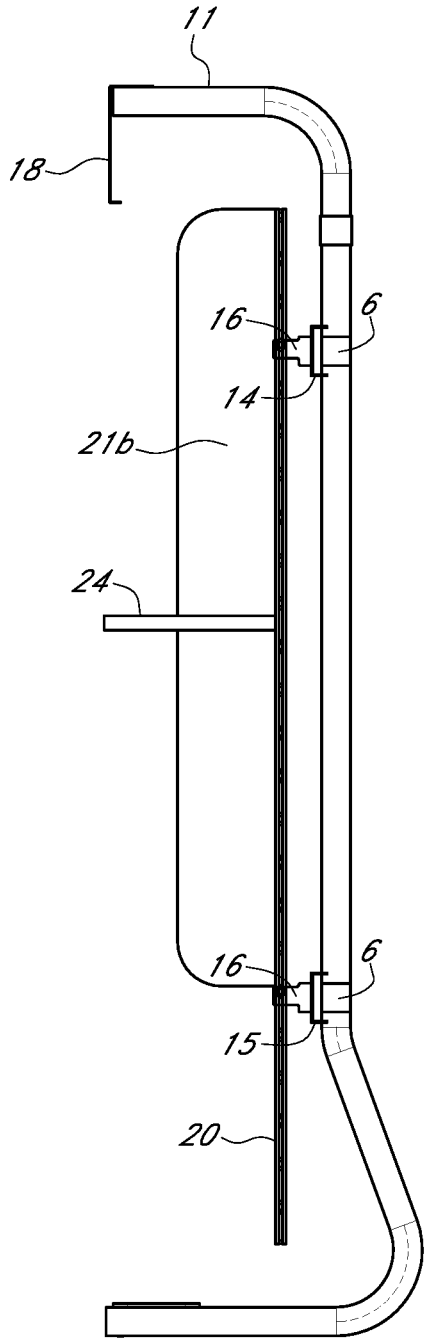
FIG. 5D is a side perspective view of a medium side panel in half extension positioned in the upper portion of the Self-Standing Merchandise Frame as shown and disclosed herein.

FIG. 5A is a side perspective view of a medium side panel 21*b* in full extension positioned in the middle portion 20*a* of the grid wall of the merchandise frame 10 as shown and disclosed herein. FIG. 5B is a side perspective view of a medium side panel 21*b* in full extension positioned in the upper portion 20*a* of the grid wall as shown and disclosed herein. FIG. 5C is a side perspective view of a medium side panel 21*b* in half extension positioned in the middle portion 20*c* of the grid wall as shown and disclosed herein. FIG. 5D is a side perspective view of a medium side panel 21*b* in half extension positioned in the upper portion 20*a* of the grid wall as shown and disclosed herein.

As shown in FIGS. 5A-5D, the medium side panel 21*b* is configured for attachment along the length (vertical dimension) of the grid wall 20. The medium side panel 21*b* may also be attached and positioned along the length of the grid wall 20 via a screw 4, a bolt 5 or a mounting bracket 6 (not shown). Due to the medium size, the medium side panel 21*b* (in full extension) may be attached to an upper portion 20*a*

(see FIG. 5B), a middle portion 20*b* (see FIG. 5A) or a lower portion 20*c* (not shown) of the grid wall 20. In one embodiment, the medium side panel 21*b* (in half extension) may be attached to an upper portion 20*a* (see FIG. 5D), a middle portion 20*b* (see FIG. 5C) or a lower portion 20*c* (not shown) of the grid wall 20. The medium side panel 21*b* is designed for multiple purposes such as merchandise separation, decoration, advertisement, etc. The medium side panel 21*b* is removable, light and adjustable which make it easy to use and convenient during transportation and storage. One of ordinary skill will appreciate that the medium side panel 21*b* can be adjusted and be positioned along the length (vertical dimension) of the grid wall 20. One of ordinary skill will also appreciate that the medium side panel 21*b* can be adjusted and be positioned along the width (horizontal dimension) of the grid wall 20, without any limitation and/or restriction unless otherwise indicated in the following claims.

Figure 6A:
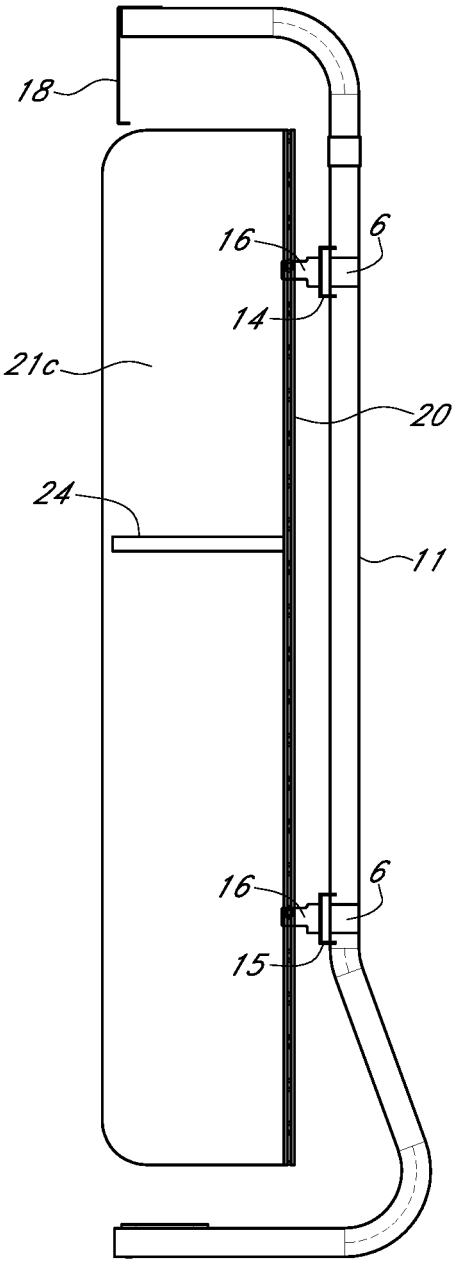
FIG. 6A is a side perspective view of a large side panel in full extension of the Self-Standing Merchandise Frame as shown and disclosed herein.
Figure 6B:
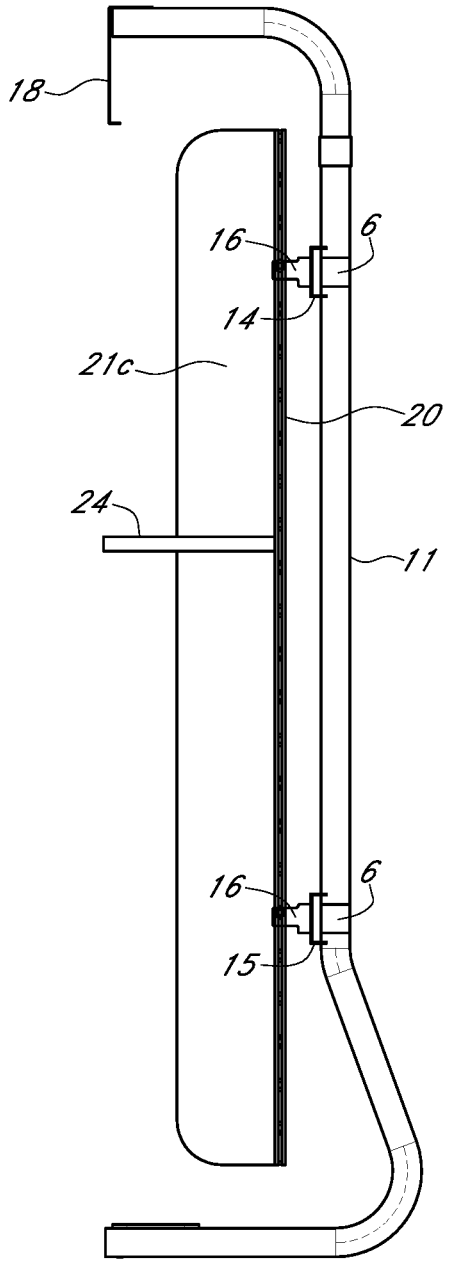
FIG. 6B is a side perspective view of a large side panel in half extension of the Self-Standing Merchandise Frame as shown and disclosed herein.

FIG. 6A is a side perspective view of a large side panel 21*c* in full extension of the self-standing merchandise frame 10 as shown and disclosed herein. FIG. 6B is a side perspective view of a large side panel 21*c* in half extension of the self-standing merchandise frame 10 as shown and disclosed herein. As shown in FIGS. 6A-6B, the large side panel 21*c* is configured for attachment along the length of the grid wall 20 wherein the large side panel 21*c* is substantially similar with the length of the grid wall 20. The large side panel 21*c* may be attached and positioned along the length of the grid wall 20 via a screw 4, a bolt 5, a hook 17 or a mounting bracket 6. The large side panel 21*c* is designed for multiple purposes such as merchandise separation, decoration, advertisement, etc. The large side panel 21*c* is removable, light and adjustable which make it easy to use and convenient during transportation and storage. One of ordinary skill will appreciate that the large side panel 21*c* can be adjusted and be positioned along the length (vertical dimension) of the grid wall 20. One of ordinary skill will also appreciate that the large side panel 21*c* can be adjusted and be positioned along the width (horizontal dimension) of the grid wall 20, without any limitation and/or restriction unless otherwise indicated in the following claims.

Figure 7:
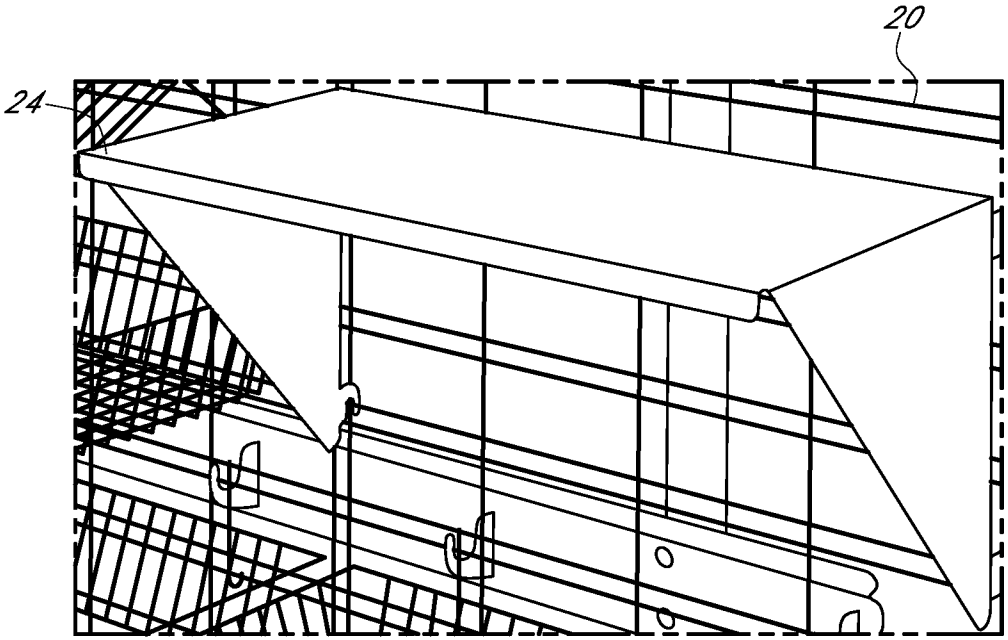
FIG. 7 is a perspective view of a shelf of the Self-Standing Merchandise Frame as disclosed herein.

FIG. 7 is a perspective view of a shelf 24 of the self-standing merchandise frame 10 as disclosed herein. As shown, the shelf 24 is configured to engage and attach to the front of the grid wall 20 via a mounting bracket 6, a hook 17, etc. without any limitation and/or restriction unless otherwise indicated in the following claims. The shelf 24 is used for merchandise display such as coffee, coffee maker, ATM, book, cup, ipad, electronic device, a microwave, coffee brewer, sales kiosk surface (see FIG. 9A) without any limitation and/or restriction. The shelf 24 may be constructed of, but not limited to, a metal, such as steel, bronze and aluminum, or a combination therein, or some other solid, durable, hard material or a combination thereof.

Figure 8:
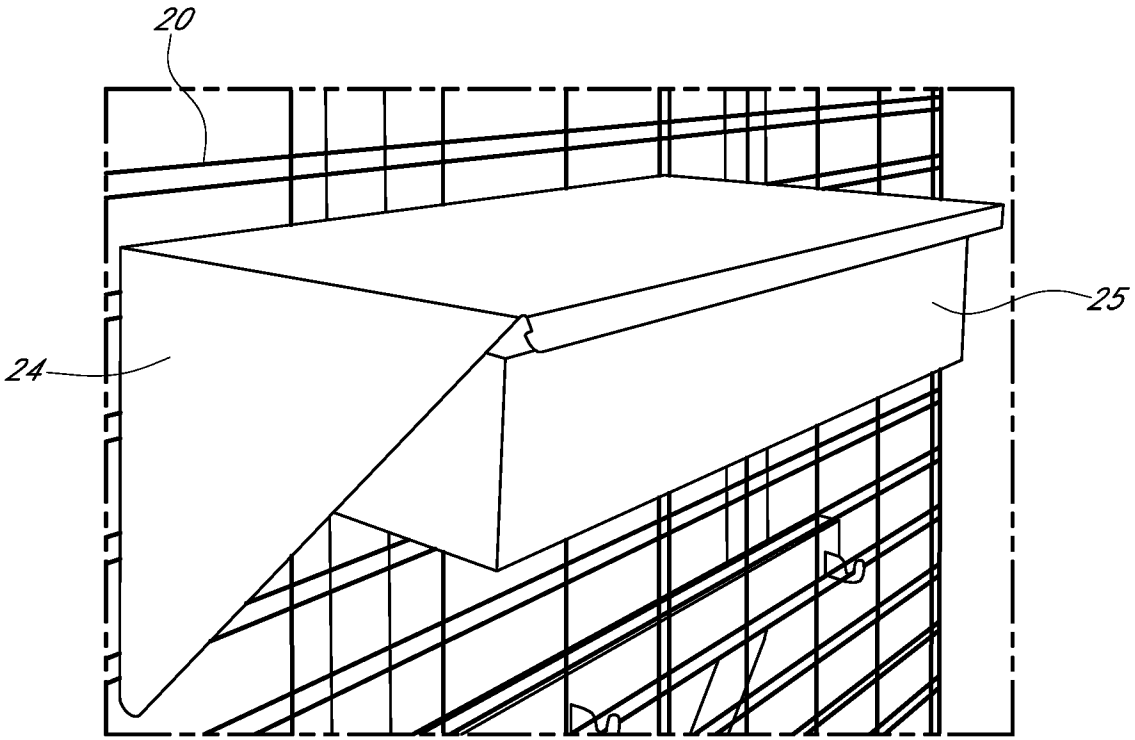
FIG. 8 is a front perspective view of the Self-Standing Merchandise Frame having a shelf and a secure access box as disclosed herein.
Figure 8A:
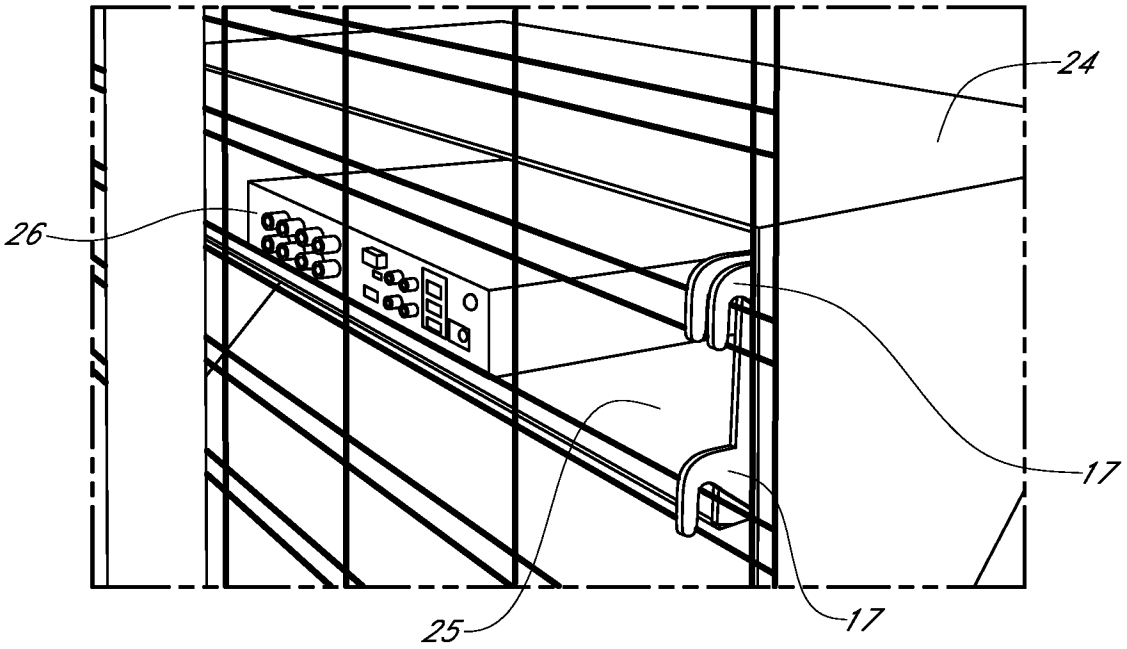
FIG. 8A is a rear perspective view of the Self-Standing Merchandise Frame having a shelf and a secure access box as disclosed herein.
Figure 8B:
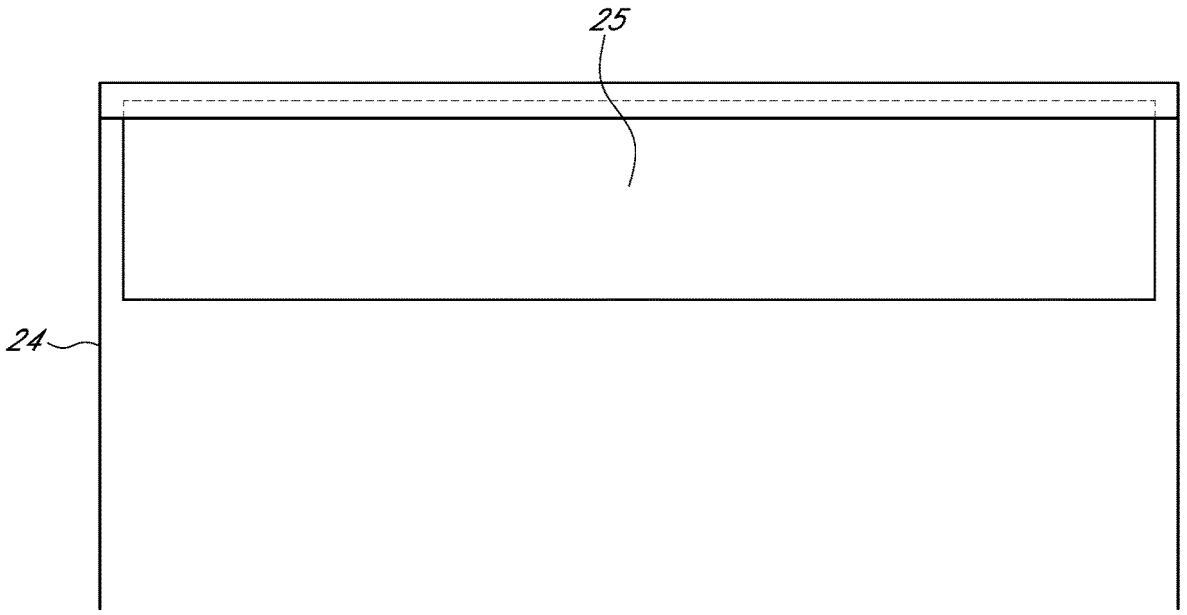
FIG. 8B is a front view of the Self-Standing Merchandise Frame having a shelf and a secure access box as disclosed herein.
Figure 8C:
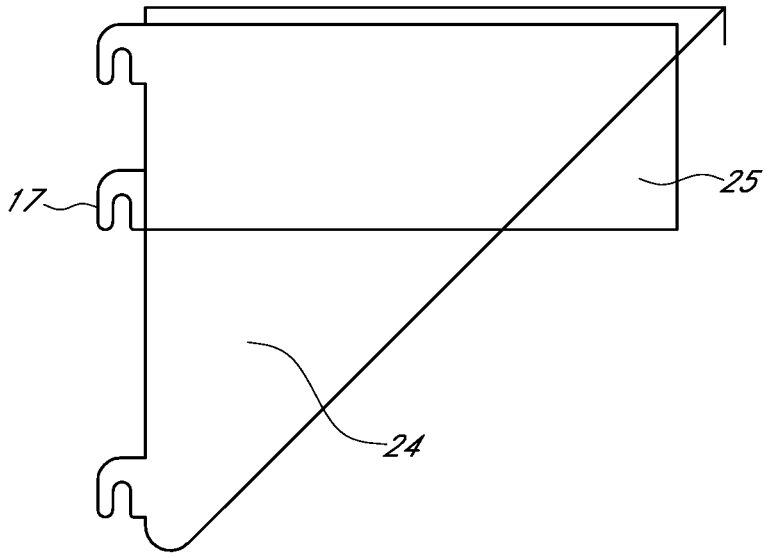
FIG. 8C is a side view of the Self-Standing Merchandise Frame having a shelf and a secure access box as disclosed herein.

FIG. 8 is a front perspective view of the self-standing merchandise frame 10 having a shelf 24 and a secure access box 25 as disclosed herein. FIG. 8A is a back-perspective view of the self-standing merchandise frame 10 having a shelf 24 and a secure access box 25 as disclosed herein. FIG. 8B is a front view of the self-standing merchandise frame 10 having a shelf 24 and a secure access box 25 as disclosed herein. FIG. 8C is a side view of the self-standing merchandise frame 10 having a shelf 24 and a secure access box 25 as disclosed herein. As shown, the secure access box 25 may be configured to store security devices wherein the secure access box 25 is only accessible from behind the grid wall 20 for enhanced security. The shelf 24 and the box may be constructed as one integral unit or separately and conventionally attached together without any limitation and/or restriction. The method of setting up the secure access box 25 comprises of two steps: attaching the shelf 24 to the grid wall 20 and attaching the secure access box 25 underneath the shelf 24 to the grid wall 20. A DVR 26, a DVD player, security devices, electronic devices may be placed inside the secure access box 25 wherein only the operator can access to the secure access box 25 from behind the grid wall 20 without any limitation and/or restriction unless otherwise indicated in the following claims.

Figure 9:
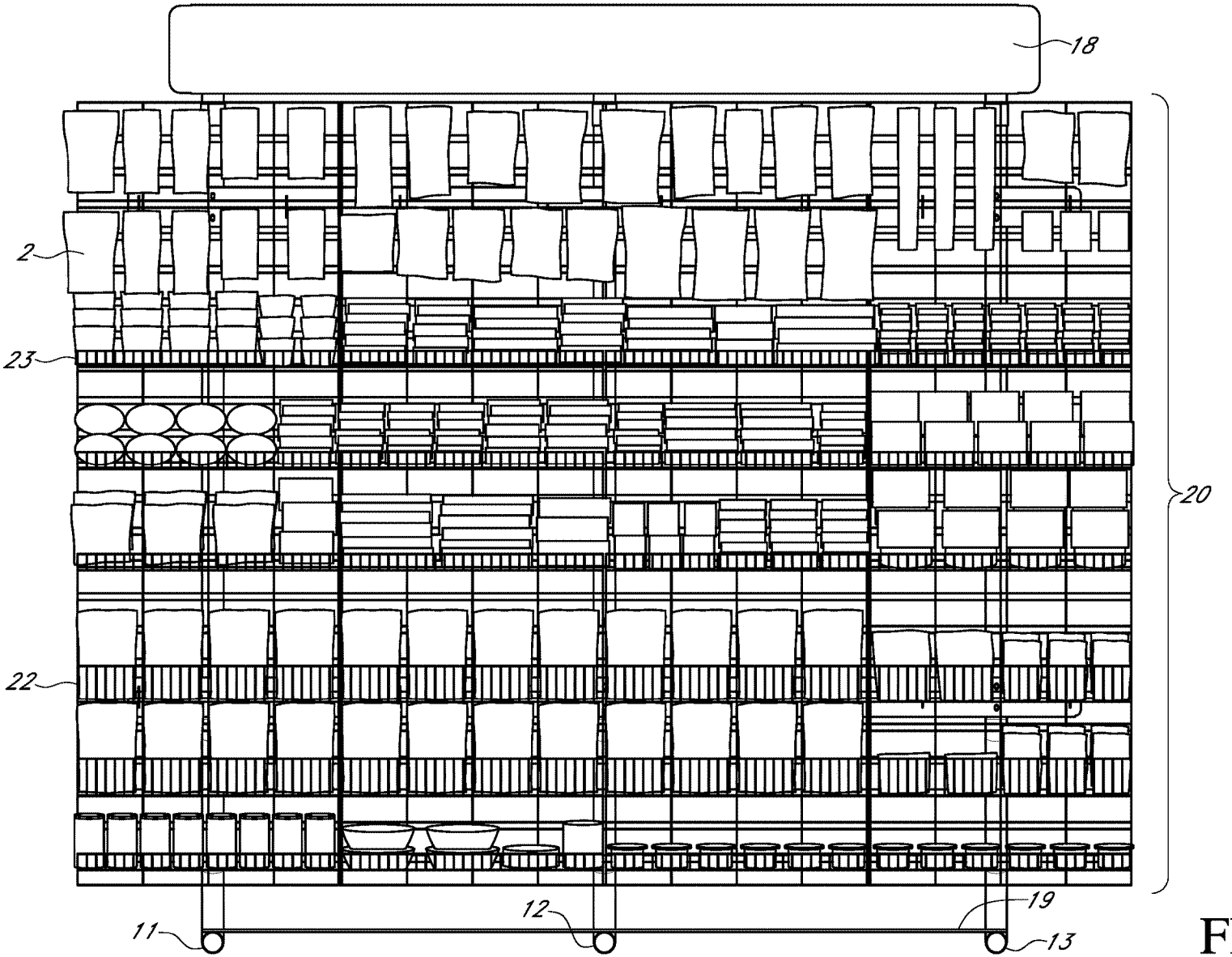
FIG. 9 is a perspective view of the Self-Standing Merchandise Frame displaying different products as disclosed herein.
Figure 9A:
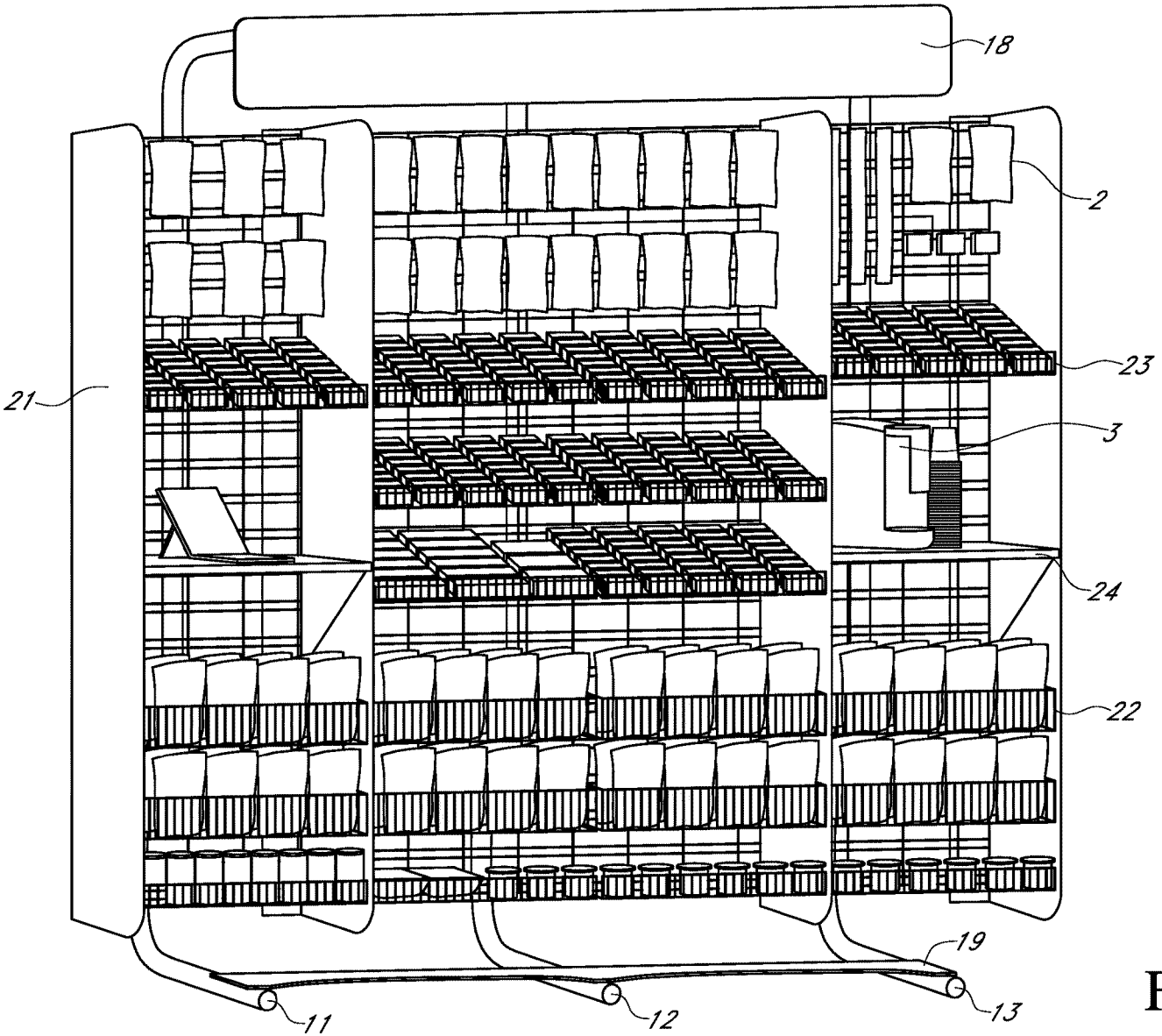
FIG. 9A is a perspective view of the Self-Standing Merchandise Frame as disclosed in FIG. 9 wherein multiple side panels for product separation have been added.

FIG. 9 is a perspective view of the self-standing merchandise frame 10 displaying different products as disclosed herein. FIG. 9A is a perspective view of the Self-standing merchandise frame 10 as disclosed in FIG. 9 wherein multiple side panels 21 for product separation have been added. Although the self-standing merchandise frame 10 is self-standing, it can be attached to a wall with an earthquake stability strap if desired or necessary. The self-standing merchandise frame 10 has many advantages such as light weight, simple, reusable and low manufacture cost.

This particular embodiment of a self-standing merchandise frame 10 has a sign plate 18 fabricated from aluminum using various laser cutting, welding, securement and machining technologies which are well known to those of ordinary skill in the art. One of ordinary skill will appreciate that the self-standing merchandise frame 10 could be constructed by any method known to those in the art including via casting, forging and machining or stamping and punching, without restriction or limitation.

One of ordinary skill will appreciate that other types of fasteners including screw, bolts and or pegs could be used without departure from the spirit and intent of the present disclosure, to allow for easy detachment or removal of the fastener during disassemble for packing or transportation.

One of ordinary skill will appreciate that the self-standing merchandise frame 10 provides a large space for merchandise display which allows multiple attachments of various types of merchandise units such as candies, chocolate, gums, etc. without any limitation and/or restriction unless otherwise indicated in the following claims. The sign plate 18 of the self-standing merchandise frame 10 (width of 48 inches and 96 inches), as compared to the sign plate 18 of the self-standing merchandise frame 10 (width of 24 inches), is wider and more space which is a great advantage for advertising and displaying merchandise label, easy to catch customer's attention and increases sale's profit.

Depending on the materials selected and purposes, the self-standing merchandise frame 10 may be designed of different shapes, sizes, and/or color without any limitation and/or restriction unless otherwise indicated in the following claims.

Another manufacturing aspect of another embodiment is cutting the tabs, hooks 17, mounting bracket 16 out of a crosspiece and then welding it back to the embodiment. Depending on different application, the crosspiece may be substituted as a sheet of metal, copper, etc. without any limitation and/or restriction. One of ordinary skill will appreciate that self-standing merchandise frame 10 provides a simple, inexpensive structure to display products or merchandises such as snacks, candies, drinks, coffee marker etc. but not limited to camera, DVR 26, without any limitation and restriction unless otherwise indicated in the following claims. One of ordinary skill will also appreciate that the embodiment could be quickly assembled and disassembled during packing or transportation which provides a unique featuring and signing which contributes to the dynamic merchandising system and store decoration.

Having described the preferred embodiments, other features of the self-standing merchandise frame 10 will undoubtedly occur to those versed in the art, as will numerous modifications and alterations in the embodiments as illustrated herein, all of which may be achieved without departing from the spirit and scope of the self-standing merchandise frame 10 disclosed herein. Accordingly, the methods and embodiments pictured and described herein are for illustrative purposes only, and the scope of the present disclosure extends to all method and/or structures for providing increased functionality, longevity, suitability and convenience in the use and access of self-standing merchandise frame 10. Furthermore, the methods and embodiments pictured and described herein are no way limiting to the scope of the self-standing merchandise frame 10 and method of use unless so stated in the following claims.

It should be noted that the self-standing merchandise frame 10 is not limited to the specific embodiments pictured and described herein but is intended to apply to all similar apparatuses and methods for providing the various benefits and/or features of a self-standing merchandise frame 10. Modifications and alterations from the described embodiments will occur to those skilled in the art without departure from the spirit and scope of the self-standing merchandise frame 10. It is understood that the self-standing merchandise frame 10 as disclosed herein extends to all alternative combinations of one or more of the individual features mentioned, evident from the text and/or drawings, and/or inherently disclosed. All of these different combinations constitute various alternative aspects of the self-standing merchandise frame 10 and/or components thereof. The embodiments described herein explain the best modes known for practicing the self-standing merchandise frame 10 and/or components thereof and will enable others skilled in the art to utilize the same. The claims are to be construed to include alternative embodiments to the extent permitted by the prior art.

It will be apparent to those skilled in the art that various modifications and variations can be made without departing from the scope or spirit. Other embodiments will be apparent to those skilled in the art from consideration of the specification and practice disclosed herein. It is intended that the specification and examples be considered as illustrative only, with a true scope and spirit being indicated by the following claims.

What is claimed is:

1. A self-standing merchandise frame configured to rest upon a floor surface, the self-standing merchandise frame comprising:

a) a first vertical tube having a first upper portion, a first upper curved radius, a first middle portion, a first lower curved radius, and a first lower portion; wherein the first upper curved radius is between the first upper portion and the first middle portion, the first upper portion is generally perpendicular relative to the first middle portion, the first lower curved radius is between the first lower portion and the first middle portion, the first lower portion is generally perpendicular relative to the first middle portion;

b) a second vertical tube having a second upper portion, a second middle portion, a second lower curved radius, and a second lower portion; the second upper portion of the second vertical tube terminates below the first upper portion of the first vertical tube so that the first vertical tube is longer than the second vertical tube, the second lower curved radius is between the second middle portion and the second lower portion, the second lower portion is generally perpendicular relative to the second middle portion;

c) a third vertical tube having a third upper portion, a third middle portion, a third lower curved radius, and a third lower portion; the third upper portion of the third vertical tube terminates below the first upper portion of the first vertical tube so that the first vertical tube is longer than the third vertical tube, the third lower curved radius is between the third middle portion and the third lower portion, the third lower portion is generally perpendicular relative to the third middle portion, wherein the second vertical tube and the third vertical tube are adjacent to the first vertical tube, wherein the first vertical tube is between the second vertical tube and the third vertical tube;

d) a base plate, the base plate is attached to and connects the first lower portion, the second lower portion, and the third lower portion;

e) an upper support, the upper support is attached to the first vertical tube, the upper support is proximate to the first upper curved radius of the first vertical tube, the upper support is above and spaced apart from the second vertical tube and the third vertical tube respectively; and a first mounting support hook extends from the upper support;

f) a lower support, the lower support is attached to and connects the first vertical tube, the second vertical tube and the third vertical tube, the lower support is proximate to the first lower curved radius;

and a second mounting support hook extends from the lower support;

wherein the first mounting support hook and the second mounting hook are configured to support a grid wall therebetween.

2. The self-standing merchandise frame according to claim 1 further comprising the grid wall, wherein the grid wall is attached to the first mounting support hook and the second mounting hook.

3. The self-standing merchandise frame according to claim 1 wherein a sign plate is configured to engage an end of the first upper portion of the first vertical tube.

4. The self-standing merchandise frame according to claim 1 wherein the first vertical tube further comprises a first angled portion, and the first angled portion is between the first middle portion and the first lower curved radius.

5. The self-standing merchandise frame according to claim 1 wherein the first lower curved radius, the second lower curved radius, and the third lower curved radius are each 10 inches respectively.

6. The self-standing merchandise frame according to claim 1 wherein the first upper curved radius is 4-10 inches.

7. The self-standing merchandise frame according to claim 1 wherein a sign plate is configured to engage the first upper portion of the first vertical tube.

8. The self-standing merchandise frame according to claim 2 further comprising at least one of a merchandise shelf, a merchandise rack, and a merchandise basket attached to the grid wall.

9. The self-standing merchandise frame according to claim 2 wherein the grid wall is configured to support at least one of a merchandise shelf, a merchandise rack, a merchandise basket, and a panel thereon is.

* * * * *